US006305783B1

(12) United States Patent
Kubota et al.

(10) Patent No.: US 6,305,783 B1
(45) Date of Patent: Oct. 23, 2001

(54) LIQUID DISCHARGE METHOD, LIQUID DISCHARGE HEAD, MANUFACTURING METHOD OF THE HEAD, HEAD CARTRIDGE, AND LIQUID DISCHARGE DEVICE

(75) Inventors: Masahiko Kubota, Tokyo; Yuji Tsuruoka, Kawasaki, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/452,181

(22) Filed: Dec. 2, 1999

(30) Foreign Application Priority Data

Dec. 3, 1998 (JP) ..... 10-344724
Dec. 3, 1998 (JP) ..... 10-344726
Dec. 3, 1998 (JP) ..... 10-344727

(51) Int. Cl.[7] ..... B41J 2/14; B41J 2/04; B41J 2/05

(52) U.S. Cl. ..... 347/48; 347/54; 347/65; 347/67

(58) Field of Search ..... 347/54, 55, 63, 347/65, 67, 48

(56) References Cited

U.S. PATENT DOCUMENTS 4,752,784 * 6/1988 Saito et al. ..... 347/55
5,278,585 * 1/1994 Karz et al. ..... 347/65
5,838,351 11/1998 Weber ..... 347/85

FOREIGN PATENT DOCUMENTS 0665590A 8/1995 (EP) ..... H01L/23/00
0738601A2 10/1996 (EP) ..... B41J/2/045
0739737A2 10/1996 (EP) ..... B41J/2/05
0811494A2 12/1997 (EP) ..... B41J/2/14
0819531A2 1/1998 (EP) ..... B41J/2/05
403213346 * 9/1991 (JP) ..... 347/48
40400105 * 1/1992 (JP) ..... 347/54

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge method is disclosed which comprises a displacement step where a movable member is displaced by generating an electrostatic force between a substrate having a thermal energy generating element for generating thermal energy which is utilized to discharge a liquid through a discharge port and the movable member disposed opposite to the thermal energy generating element and having a free end on a downstream side in the flow direction of the liquid to thereby displace a liquid surface at the discharge port to an upstream side in the flow direction of the liquid; and a discharge step where the movable member is displaced owing to a bubble formed by the thermal energy generated by the thermal energy generating element to discharge the liquid through the discharge port. In addition, there are also herein disclosed a liquid discharge head, a manufacturing method of the head, a head cartridge, a liquid discharge device, and the like.

18 Claims, 21 Drawing Sheets

LIQUID DISCHARGE METHOD, LIQUID DISCHARGE HEAD, MANUFACTURING METHOD OF THE HEAD, HEAD CARTRIDGE, AND LIQUID DISCHARGE DEVICE

BACKGROUND OF THE INVENTION

1. Field of the Invention

The present invention relates to a liquid discharge method, a liquid discharge head, a manufacturing method of the head, a head cartridge, and a liquid discharge device used in a printer, a video printer or the like, as an output terminal of a copying machine, a facsimile, a word processor, a host computer or the like. In particular, it relates to a liquid discharge method, a liquid discharge head, a manufacturing method of the head, a head cartridge and a liquid discharge device, wherein a base body on which an electricity-heat conversion element generating thermal energy utilized as energy for recording is provided, and recording is performed by discharging a liquid (ink or the like) for recording from a discharge port (orifice) as flying droplets, and making them adhere to a recording medium.

Note that the present invention is an invention capable of applying to a device such as a printer, a copying machine, a facsimile having a communication system, a word processor having a printer part or the like, wherein recording is performed to media to be recorded, such as papers, yarns, fibers, dishcloths, hides, metals, plastics, glasses, woods, ceramics or the like, and further, a recording device for industry combined with various processors in a complex manner. Here, "recording" in the present invention means not only to give an image having a meaning, such as a character, a figure or the like, to a medium to be recorded, but also to give an image having no meaning, such as a pattern or the like.

2. Related Background Art

An ink jet recording method, so-called bubble jet recording method, wherein, by giving an ink thermal energy, a change in state with a rapid change in volume is produced in the ink, the ink is discharged from a discharge port by an action force based on this change in state of the ink, and it is made to adhere to a medium to be recorded to perform an image formation, has been hitherto known. A recording device using this bubble jet recording method is representatively disclosed in U.S. Pat. No 4,723,129 specification.

Further, as an improvement invention of this bubble jet recording method, a device in which a movable member is opposite to a heating body as disclosed in Japanese Patent Application Laid-open No. 10-24577, has been proposed.

SUMMARY OF THE INVENTION

It is one of the objects of the present invention to raise the discharge characteristic of a device in which an air bubble, particularly, an air bubble attendant upon film boiling is generated in a liquid flow passage and a liquid is discharged, to a higher level.

It is another object of the present invention to provide a liquid discharge method, a liquid discharge head, a head cartridge, and a liquid discharge device wherein the discharge characteristics are stable and high reliability is obtained.

It is still another object of the present invention to provide a manufacturing method of a liquid discharge head capable of manufacturing a movable member of a liquid discharge head in high density with high accuracy.

It is further another object of the present invention is to provide a liquid discharge method which comprises a displacement step where a movable member is displaced by generating an electrostatic force between a substrate having a thermal energy generating element for generating thermal energy which is utilized to discharge a liquid through a discharge port and the movable member disposed opposite to the thermal energy generating element and having a free end on a downstream side in the flow direction of the liquid to thereby displace a liquid surface at the discharge port to an upstream side in the flow direction of the liquid, and a discharge step where the movable member is displaced owing to a bubble formed by the thermal energy generated by the thermal energy generating element to discharge the liquid through the discharge port.

It is further another object of the present invention is to provide a liquid discharge head which comprises a substrate having a thermal energy generating element for generating thermal energy which is utilized to discharge a liquid through a discharge port, and a movable member which is disposed opposite to the thermal energy generating element and which has a free end on a downstream side in the flow direction of the liquid and which is equipped with a movable member side electrode for generating an electrostatic force between the electrode itself and the substrate, the movable member being displaced owing to a bubble formed by the thermal energy generated by the thermal energy generating element to discharge the liquid through the discharge port.

It is further another object of the present invention is to provide a manufacturing method of a liquid discharge head comprising a substrate having a thermal energy generating element for generating thermal energy which is utilized to discharge a liquid through a discharge port, and a movable member which is disposed opposite to the thermal energy generating element and which has a free end on a downstream side in the flow direction of the liquid and which is equipped with a movable member side electrode for generating an electrostatic force between the electrode itself and the substrate, the manufacturing method comprising:

a step of forming a first inorganic material film on the substrate, and patterning the first inorganic material film into a predetermined shape, a step of forming a second inorganic film on the substrate and the first inorganic material film, and patterning the second inorganic material film into a predetermined shape, a step of forming the movable member side electrode on the second inorganic material film, a step of forming, on the movable member side electrode and the second inorganic material film, a wiring layer for connecting the movable member side electrode to a drive circuit disposed on the substrate, a step of forming a third inorganic material film on the wiring layer, and a step of removing the first inorganic material film to thereby form the movable member.

It is further another object of the present invention is to provide a liquid discharge head manufactured by the manufacturing method described above.

It is further another object of the present invention is to provide a head cartridge which integrally comprises a liquid discharge head described above, and a liquid container for accommodating a liquid which is supplied to the liquid discharge head.

It is further another object of the present invention is to provide a liquid discharge device which comprises a liquid discharge head described above, and supply means for giving a drive signal for discharging a liquid from the liquid discharge head.

It is further another object of the present invention is to provide a liquid discharge device which comprises a liquid discharge head described above, and carrier means for carrying a record medium to be recorded with the liquid discharged from the liquid discharge head.

In the present invention, since a liquid discharge action is performed after a liquid having protruded from a discharge port is retreated into a liquid flow passage, the droplet quantity being discharged can be stabilized. Consequently, the quality of a recorded image can be improved.

Besides, in the present invention, since the moment a droplet separates from a liquid surface in a discharge port, the liquid surface is displaced to the upstream side in the flow direction of a liquid, it becomes possible to make the quantity of the liquid drawn back into a liquid flow passage uniform each discharge action, and it becomes possible to reduce or prevent the phenomenon that the liquid near the discharge port becomes a trailing shape so as to follow a flying droplet, and the phenomenon that small droplets, which are satellite droplets, fly after a main droplet. Consequently, the quality of a recorded image can be improved.

Further, in the present invention, because the time since a movable member is displaced upward to the maximum till it is displaced downward becomes short, it becomes possible to improve the liquid discharge frequency.

DETAILED DESCRIPTION OF THE PREFERRED EMBODIMENTS

Embodiments of the present invention will be described with reference to drawings.

Figure 1:
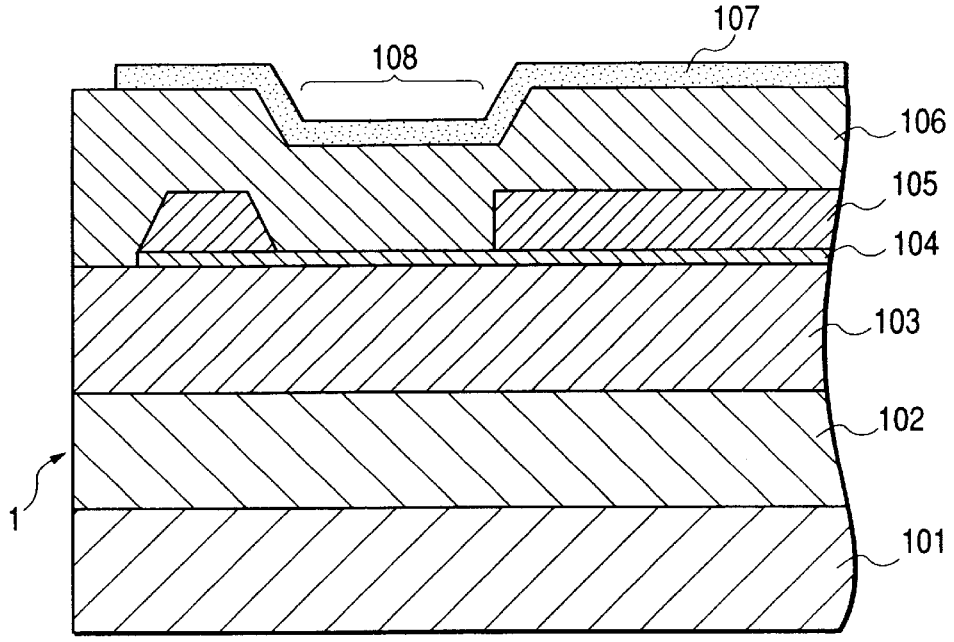
FIG. 1 is a typical sectional view showing a portion corresponding to an ink passage of an element substrate in a liquid discharge head of the present invention.

FIG. 1 shows a sectional view of a portion corresponding to an ink passage of an element substrate in a liquid discharge head of the present invention. In FIG. 1, a reference 101 denotes a silicon substrate, and a reference 102 denotes a thermal oxidation film that is a heat storage layer. A reference 103 denotes an $SiO_2$ film or an $Si_3N_4$ film that is an interlayer film doubling as a heat storage layer, a reference 104 denotes a resistance layer, a reference 105 denotes an interconnection of Al or an Al alloy such as Al—Si, Al—Cu or the like, and a reference 106 denotes an $SiO_2$ film or an $Si_3N_4$ film that is a protection film. A reference 107 denotes an anti-cavitation film for protecting the protection film 106 from chemical and physical impacts attendant upon heat generation of the resistance layer 104. Besides, a reference 108 denotes a thermal action portion of the resistance layer 104 in a region where the electrode interconnection 105 is not formed. These drive elements are formed on the Si substrate by a semiconductor technique, and the thermal action portion is further formed on the same substrate.

Figure 2:
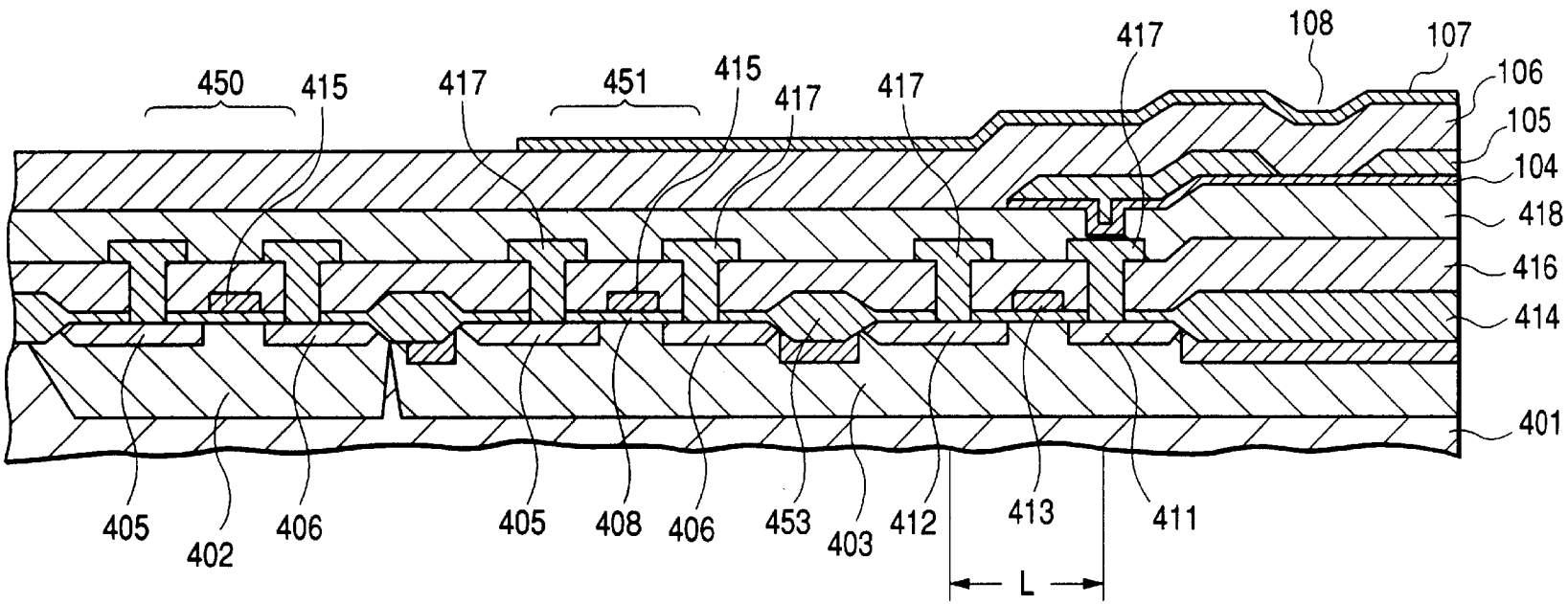
FIG. 2 is a typical sectional view cutting so as longitudinally to cut principal elements of the element substrate in the liquid discharge head.

FIG. 2 shows a typical sectional view when cutting so as longitudinally to cut principal elements of the element substrate in the liquid discharge head.

In a Si substrate 401 of a P conductive body, a P-Mos 450 in an N-type well region 402 and an N-Mos 451 in a p-type well region 403 are constructed by using a general Mos process and impurity introduction such as ion-implantation or the like, and diffusion. The P-Mos 450 and the N-Mos 451 comprises gate interconnections 415 by poly-Si deposited by a CVD method into a thickness not less than 4000 Å and not more than 5000 Å via the respective several hundreds Å thick gate insulating films 408, and source regions 405 and drain regions 406 into which N-type or P-type impurity introduction was performed, etc., and a C-Mos logic is constructed by those P-Mos and N-Mos.

Besides, an N-Mos transistor for element drive is constructed by a drain region 411, a source region 412, and a gate interconnection 413, etc., in a P-well substrate also by steps of impurity introduction and diffusion, etc.

Note that, although this example explains by the structure using the N-Mos transistor, it is not limited to this if it is a transistor having an ability capable of individually driving a plurality of heating elements, and having a function capable of attaining such a minute structure as described above.

Besides, between each element, an oxide film isolation region 453 is formed by field oxidation of a thickness not less than 500 Å and not more than 10000 Å, and element isolation is made. This field oxide film acts as a heat storage layer 414 of the first layer below the thermal action portion 108.

After each element is formed, an interlayer insulating film 416 is deposited by PSG (Phospho-Silicate Glass), BPSG (Boron-doped Phospho-Silicate Glass) film or the like, by a CVD method, and, after flattening processing or the like is performed by thermal processing, via a contact hole, interconnection is made by an Al electrode 417 to be the first interconnection layer. After that, an interlayer insulating film 418 such as an $SiO_2$ film or the like by a plasma CVD method was deposited into a thickness not less than 10000 Å and not more than 15000, and further, via a through hole, an about 1000 Å thick $TaN_{0.8,hex}$ film was formed as the resistance layer 104 by a DC sputter method. After that, the second interconnection layer Al electrode to be interconnection to each heating body was formed.

Next, the protection film 106 is that an $Si_3N_4$ film by plasma CVD is formed into the thickness of about 10000 Å. At the uppermost layer, the anti-cavitation film 107 is deposited by amorphous tantalum into the thickness of about 2500 Å. As the material of the anti-cavitation film 107, for strengthening the electrostatic force between a heating body and a movable member as described later, an amorphous metal, which is weaker in conductivity than a metal film, was selected. Thereby, it is confirmed that an electrostatic effect arises between both. Beside, as the material of the anti-cavitation film 107, nitride (BN, TiN), carbide (WC, TiC, BC) or the like, which are insulating materials that are further weaker in conductivity and relatively high in specific inductive capacity, may also be used.

Figure 3:
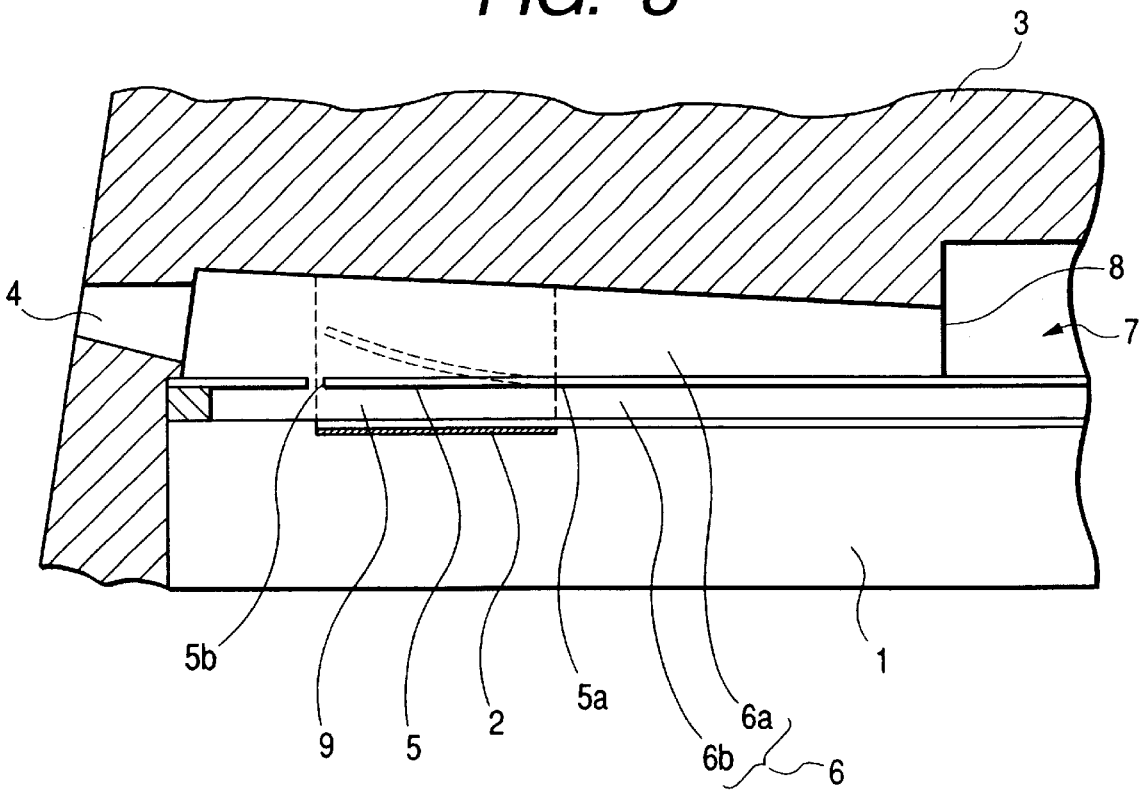
FIG. 3 is a typical sectional view along a liquid flow passage direction, for illustrating the fundamental structure of an embodiment of a liquid discharge head of the present invention.
Figure 4:
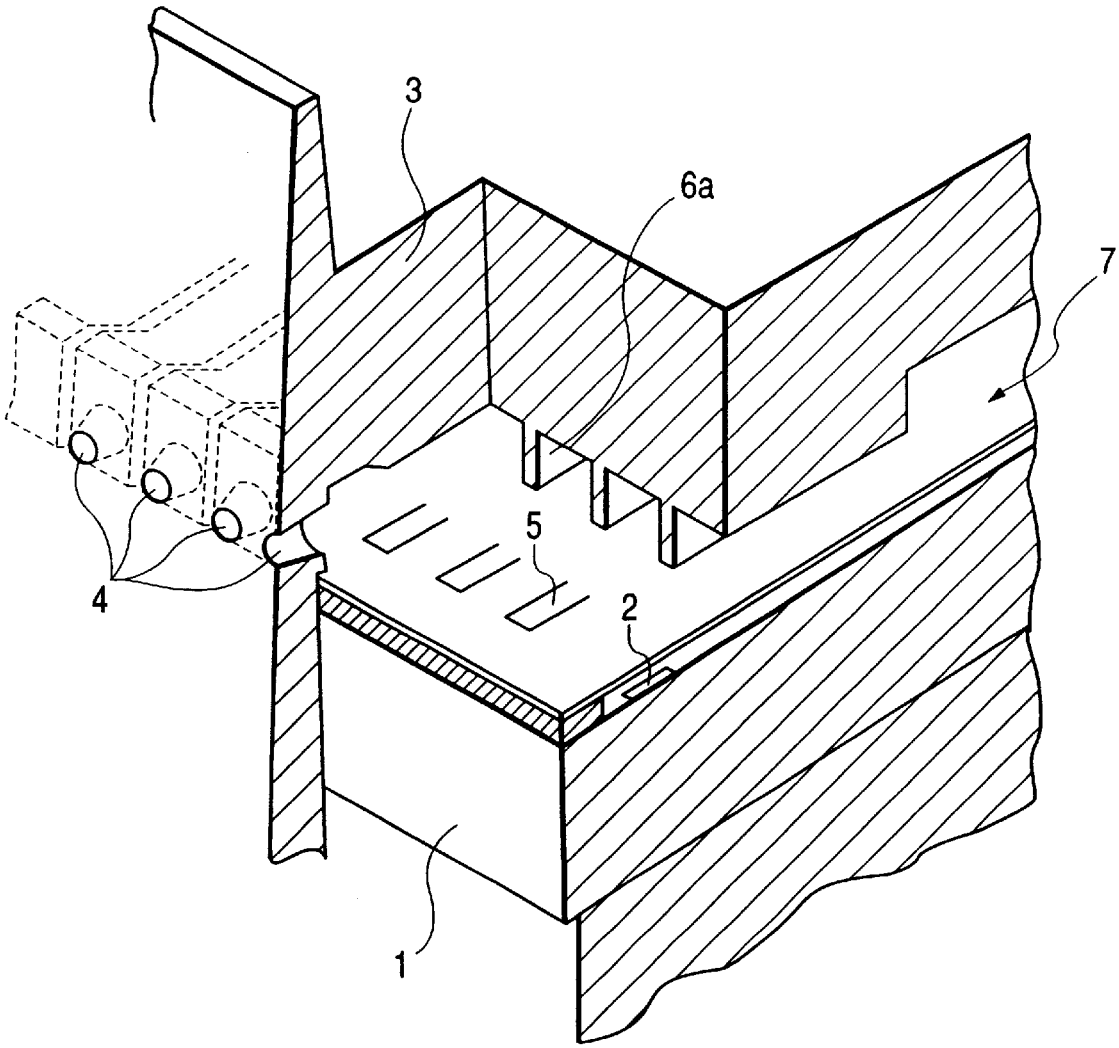
FIG. 4 is a typical perspective view showing by cutting off part of the liquid discharge head shown in FIG. 3.

FIG. 3 is a sectional view along a liquid flow passage direction, for illustrating the fundamental structure of an embodiment of a liquid discharge head of the present invention, and FIG. 4 is a perspective view showing by cutting off part of the liquid discharge head shown in FIG. 3. A liquid discharge head of this embodiment has an element substrate 1 on which a plurality of heating bodies 2 (only one is shown in FIG. 3) that are bubble generation elements giving a liquid thermal energy for generating a bubble, are provided in parallel, and a top plate 3 joined onto this element substrate 1.

The element substrate 1 is that a silicon oxide film or a silicon nitride film aiming at insulating and heat storage is formed on a base body such as silicon or the like, and an electric resistance layer constituting the heating body 2 and an interconnection electrode are patterned thereon. The heating body 2 generates heat by applying a voltage from this interconnection electrode to the electric resistance layer and flowing a current in the electric resistance layer.

The top plate 3 is for constructing a plurality of liquid flow passages 6 corresponding to each heating body 2 and a common liquid chamber 7 for supplying a liquid to each liquid flow passage 6, and a flow passage side wall 8 extending from the roof portion between each heating body 2 is integrally provided. The top plate 3 is made of silicon type material, and can be formed by forming a pattern of the liquid flow passages 6 and the common liquid chamber 8 by etching, or after depositing a material to be the flow passage side wall 8 such as silicon nitride or silicon oxide, by a known film formation method such as CVD, on a silicon substrate, etching the portion of the liquid flow passages 6.

A wall portion is provided on a tip end surface of the top plate 3, and a plurality of discharge ports 4 (see FIG. 4) which correspond to each liquid flow passage 6 and communicate with the common liquid chamber 7 via the liquid flow passages 6, respectively, is formed in this wall portion.

Further, in this liquid discharge head, a cantilever-like movable member 5 disposed to face a heating body 2 is provided so as to divide a liquid flow passage 6 into a first liquid flow passage **6*a* communicating with a liquid discharge port 4, and a second liquid flow passage 6*b* having the heating body 2. The movable member 5** is made of a thin film of a silicon type material such as silicon nitride or silicon oxide, or nickel which is excellent in elasticity.

This movable member 5 is disposed at a position facing the heating body 2 in a state of covering the heating body 2 at a predetermined distance from the heating body 2, so as to have a fulcrum **5*a* on the upstream side of a big flow flowing from the common liquid chamber 7 via the upper part of the movable member 5 to the discharge port 4 side by a discharge action of a liquid, and near the support fixture portion of the movable member 5 to the element substrate 1, and further a free end 5*b* on the downstream side in relation to this fulcrum 5*a*. This space between the heating body 2 and the movable member 5 becomes a bubble generation region 9**.

Note that, here, "upstream" and a "downstream" are expressed as an expression in relation to the flow direction of a liquid from a supply source of the liquid via the upper part of the bubble generation region 9 (or the movable member 5) toward the discharge port 4, or a direction on this construction.

Next, a manufacturing method of the movable member of the liquid discharge head of this embodiment will be described with reference to FIGS. 5A to 5E. FIGS. 5A to 5E are sectional views along a liquid flow passage direction, showing manufacturing steps of the movable member in the liquid discharge head.

Figure 5A:
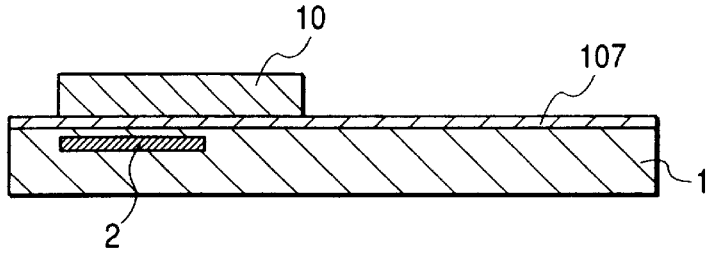
FIGS. 5A, 5B, 5C, 5D and 5E are typical sectional views along a liquid flow passage direction, showing manufacturing steps of a movable member in a liquid discharge head according to the first embodiment of the present invention.

First, as shown in FIG. 5A, after a PSG film 10 that is the first inorganic material film is formed using a plasma CVD method into the thickness of 5 μm on the anti-cavitation film 107 of the element substrate 1, patterning into a predetermined shape is performed by a photolithography process and etching.

Figure 5B:
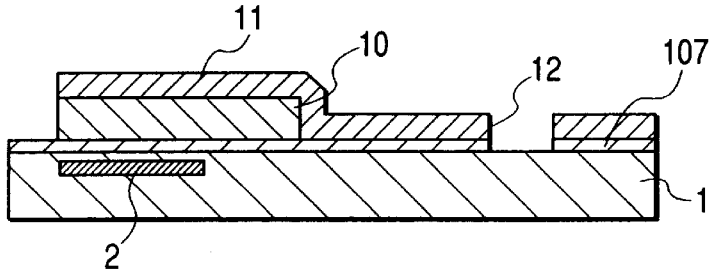

Next, as shown in FIG. 5B, after an SiN film 11 that is the second inorganic material film is formed using a plasma CVD method into the thickness of 2 μm on the anti-cavitation film 107 and the PSG film 10, it is patterned into a predetermined shape by a photolithography process and etching. After that, a through hole portion 12 to pierce the SiN film 11 and the anti-cavitation film 107 is formed by a photolithography process and etching.

Figure 5C:
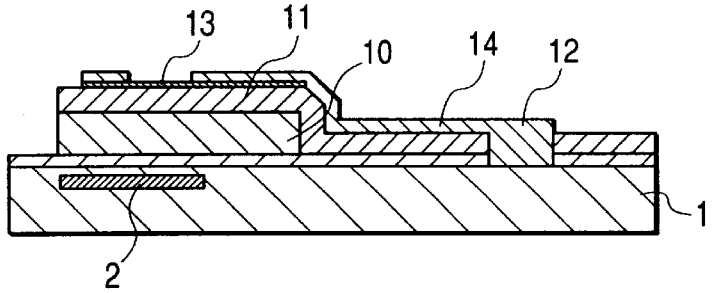

Next, as shown in FIG. 5C, an electrode portion 13 made of platinum (Pt) is formed into a 1000 Å thick film as a movable member side electrode, using a sputtering method on the portion of the SiN film 11 formed on the PSG film 10. Successively, an aluminum film 14 to be an interconnection layer for connecting the electrode portion 13 to a drive circuit (not shown) provided on the element substrate 1, is formed into the thickness of 0.5 μm using a sputtering method on the SiN film 11 and the electrode portion 13, and patterned by a photolithography process and etching.

Figure 5D:
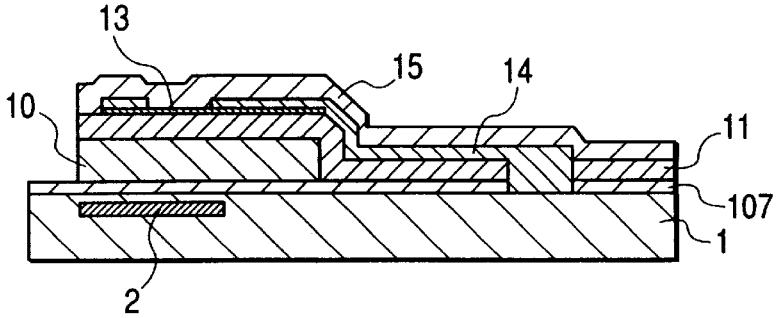

Next, as shown in FIG. 5D, an SiN film 15 that is the third inorganic material film is formed into the thickness of 2.5 μm using a plasma CVD method on the aluminum film 14, etc., and patterned by a photolithography process and etching.

Figure 5E:
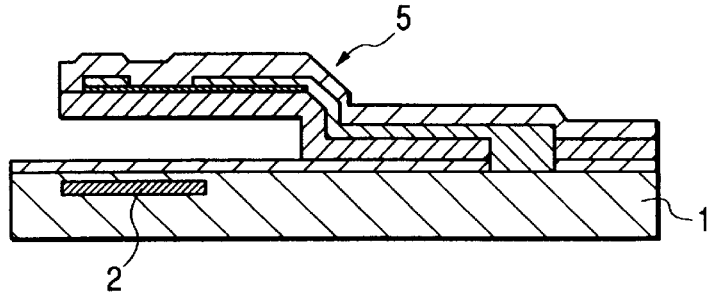

Lastly, by removing the PSG film 10 that is the first inorganic film, using a mixture aqueous solution of ammonia and fluoric acid, a movable member 5 is formed on the element substrate 1, as shown in FIG. 5E.

Note that, as the material of the first inorganic film, BPSG (Boron-doped Phospho-Silicate Glass), silicon oxide, or aluminum may also be used, other than PSG (Phospho-Silicate Glass).

Next, the fundamental concept of liquid discharge by the liquid discharge head according to the first embodiment of the present invention will be concretely described with reference to FIGS. 6A to 6E. FIGS. 6A to 6E are sectional views in a flow passage direction, for illustrating a discharge method by the liquid discharge head according to the first embodiment of the present invention.

Figure 6A:
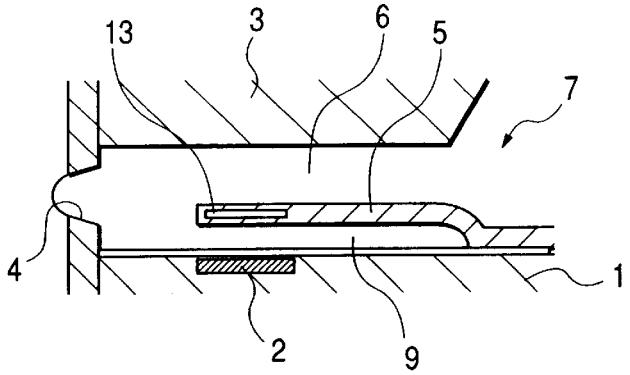
FIGS. 6A, 6B, 6C, 6D and 6E are typical sectional views in a flow passage direction, for illustrating a discharge method by the liquid discharge head according to the first embodiment of the present invention.
Figure 6B:
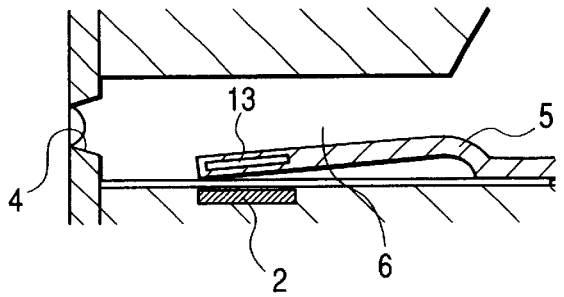

As shown in FIGS. 6A to 6B, a discharge port 4 is disposed in an end portion region of a liquid flow passage 6, and a movable member 5 is disposed on the upstream side of the discharge port 4. The interior of the liquid flow passage 6 directly communicating with the discharge port 4 is filled with a liquid supplied from the common liquid chamber 7. The movable member 5 is displaceable by an electrostatic attraction generated between a heating body 2 provided on the element substrate 1 and an electrode portion 13 provided on the movable member 5, and further, it is displaceable with growth and contraction of a bubble generated in a bubble generation area 9. Note that the movable member 5 is displaced to the element substrate 1 side by the above electrostatic attraction, and displaced to the top plate 3 side with the growth of the bubble.

FIG. 6A shows the state that the meniscus of the liquid oscillating by discharging the liquid one after another, or the like, slightly protrudes from the discharge port 4.

Next, by applying a voltage to the heating body 2 provided on the element substrate 1 and grounding the electrode portion 13 provided on the movable member 5, an electrostatic attraction is generated between both electrodes, and the movable member 5 is displaced to the element substrate 1 side, as shown in FIG. 6B. With that, the liquid surface of the liquid having protruded from the discharge port 4 becomes in the state of retreating within the liquid flow passage 6 by a certain distance. Thereby, it becomes possible to stabilize the liquid discharge quantity per each liquid discharge action. The electrostatic attraction acting at this time is shown by the following expression:

$$P=\in(V/d)^2$$

Here, P represents the electrostatic force [N/m$^2$], $\in$ represents the dielectric constant, V represents the applied voltage [V], and d represents the distance between the electrodes [m]. Note that it is preferable that the used liquid has a relatively high specific inductive capacity.

Figure 6C:
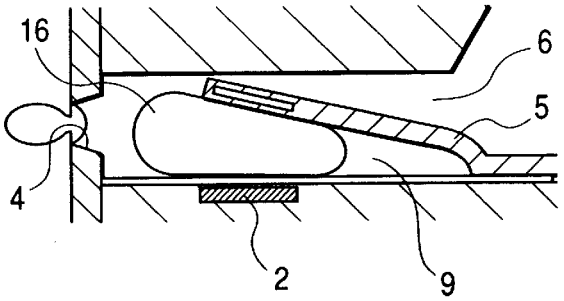

Next, as shown in FIG. 6C, when heat generation energy is given to the heating body 2 and the heating body 2 is rapidly heated, the surface of the heating body 2 contacting with the liquid in the bubble generation region 9 heats and bubbles the liquid. A bubble 16 generated by this heating and bubbling is a bubble based on a film boiling phenomenon as described in the U.S. Pat. No 4,723,129 specification, and generated with an extremely high pressure on the surface of the heating body 2 all at once. The pressure generated at this time becomes a pressure wave to be propagated in the liquid within the liquid flow passage 6, and acts on the movable member 5, and thereby, the movable member 5 is displaced to make the liquid in the liquid flow passage 6 fly from the discharge port 4. The bubble generated over the whole of the surface of the heating body 2 rapidly grows to be film-like, and, after that, the expansion of the bubble due to the extremely high pressure in the early stage of the generation continues to grow to the maximum bubbling diameter as the bubble 16 shown in FIG. 6C.

Figure 6D:
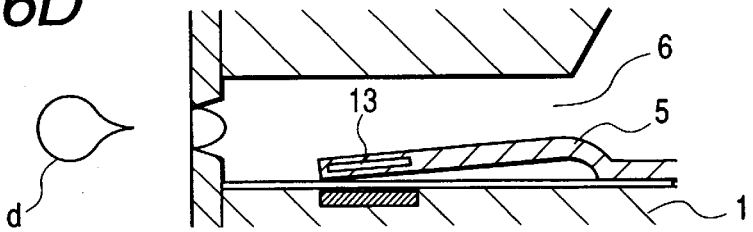

Next, by, the moment the flying liquid (droplet) separates from the liquid surface in the discharge port 4, applying a voltage to the heating body 2 provided on the element substrate 1 and grounding the electrode portion 13 provided on the movable member 5, an electrostatic attraction is generated between both electrodes, and the movable member 5 is displaced to the element substrate 1 side, as shown in FIG. 6D. By this action, the quantity of the liquid drawn back into the liquid flow passage 6 can be the same per each discharge action. Further, the phenomenon that the liquid near the discharge port 4 becomes a trailing shape so as to follow the flying liquid (droplet) d, and the phenomenon that small droplets, which are satellite droplets, fly after the main droplet, can be avoided.

Besides, by applying a voltage to the heating body 2 provided on the element substrate 1 and grounding the electrode portion 13 provided on the movable member 5 between the states shown in FIGS. 6C and 6D, the time from the state shown in FIG. 6C to the state shown in FIG. 6D, that is, the time since the movable member 5 is displaced to the top plate 3 side to the maximum till the movable member 5 is displaced to the element substrate 1 side can be shortened, and it becomes possible to improve the liquid discharge frequency.

Figure 6E:
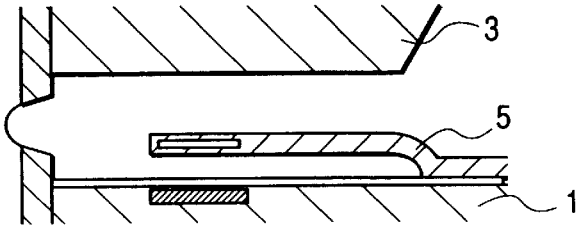

Lastly, when the movable member 5 returns to the original position by its own elastic force, the liquid discharge head becomes the initial state via the state of FIG. 6E.

Figure 7:
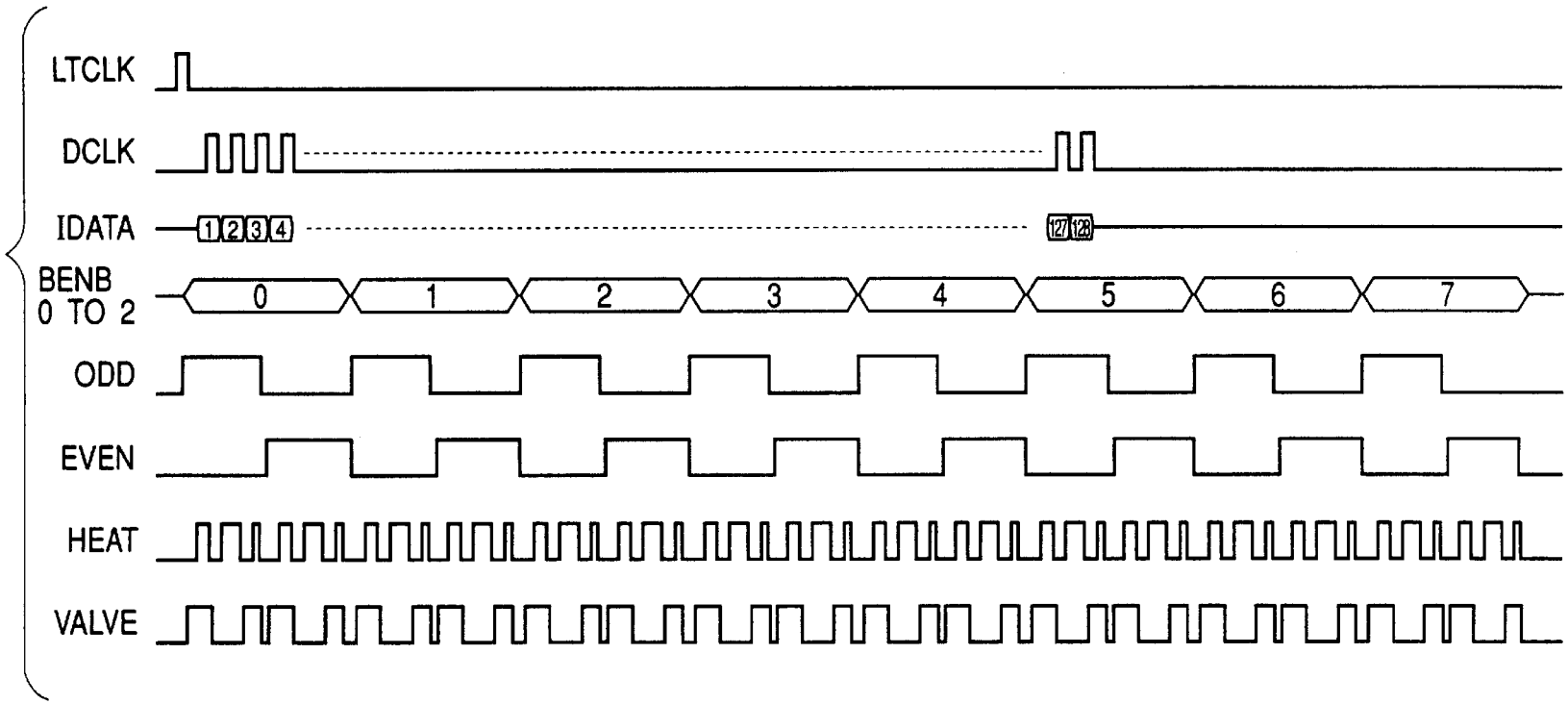
FIG. 7 is a timing chart of signals input to a heating body and an electrode portion or the like provided in the movable member, for executing the discharge principle according to the first embodiment of the present invention.

FIG. 7 shows a timing chart of signals input to the heating body 2 and the electrode portion 13 or the like provided in the movable member 5, for executing the discharge principle of the present invention shown in FIGS. 6A to 6E.

In this embodiment, at the first, a VALVE signal is made at the high level (hereinafter, called "H level"), and the movable member 5 that is a valve is made at the GND level. And, when a preheat signal is applied, the valve is displaced to the heating body 2 side that is a heater, and retreats the meniscus in the discharge port. After that, after the application of the preheat signal is completed, by making the VALVE signal at the low level (hereinafter, called "L level") to discharge the charges of the valve and set the valve at the GND level, the valve is returned to the original position.

Next, by applying a main heat signal, a droplet is discharged from the discharge port. At this time, the valve serves to arrest the rearward growth of a bubble.

Next, the VALVE signal is made at the H level, and the valve is made at the GND level. And, when the preheat signal is applied, the valve is displaced to the heater side, and accelerates the refilling speed of the liquid to the liquid flow passage. After that, the VALVE signal is made at the L level to return the valve to the original position.

Figure 8:
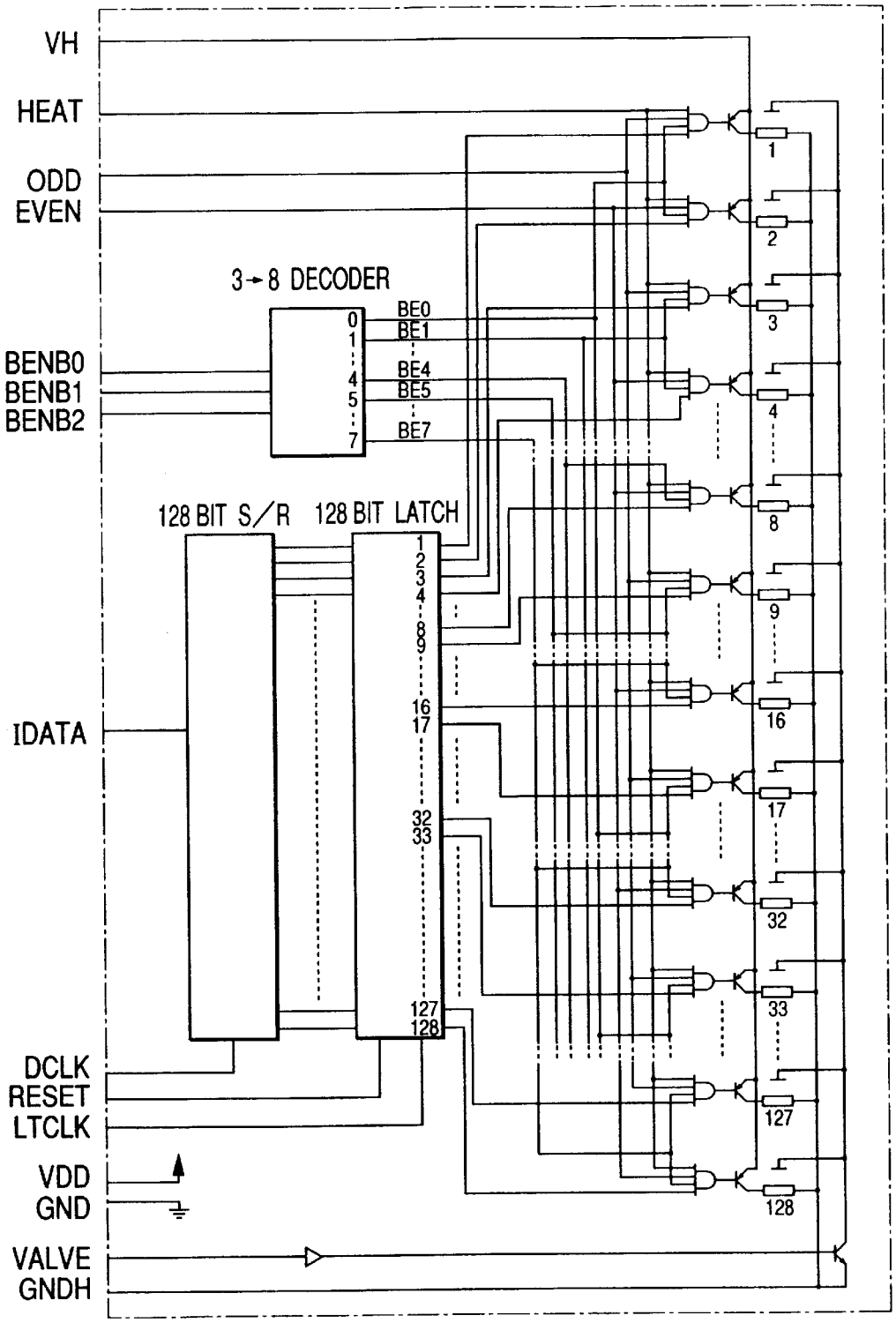
FIG. 8 is an equivalent circuit diagram of an electric circuit constructed on an element substrate according to the first embodiment of the present invention.

FIG. 8 is an equivalent circuit of an electric circuit constructed on the element substrate, which comprises, other than the heating body 2 in the liquid flow passage constituting one nozzle, the electrode portion 13 provided in the movable member 5, and drive transistors driving them individually, a shift register for drive signal processing, a latch circuit maintaining data, and an AND circuit connected to each transistor. The AND circuit logically calculates a block selection signal for block-dividing an ink flow passage constituting a nozzle, a valve signal applied to each movable member 5, and a drive pulse signal applied to those data and each heating body 2, and drives the corresponding transistor on the basis of the calculation result. Besides, the valve signal individually displacing the movable members 5 is normally open, and driven to the ground in correspondence to the drive pulse signal applied to each heating body 2.

Next, a manufacturing method of a movable member of a liquid discharge head according to the second embodiment of the present invention will be described with reference to FIGS. 9A to 9E. FIGS. 9A to 9E are sectional views along a liquid flow passage direction, showing manufacturing steps of the movable member in the liquid discharge head.

Figure 9A:
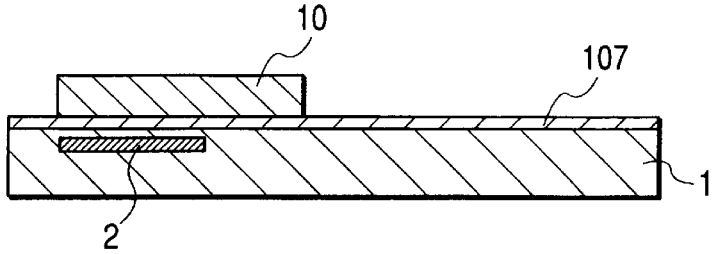
FIGS. 9A, 9B, 9C, 9D and 9E are typical sectional views along a liquid flow passage direction, showing manufacturing steps of a movable member in a liquid discharge head according to the second embodiment of the present invention.

First, as shown in FIG. 9A, after a PSG film 10 that is the first inorganic material film is formed using a plasma CVD method into the thickness of 5 μm on the anti-cavitation film 107 of the element substrate 1, patterning into a predetermined shape is performed by a photolithography process and etching.

Figure 9B:
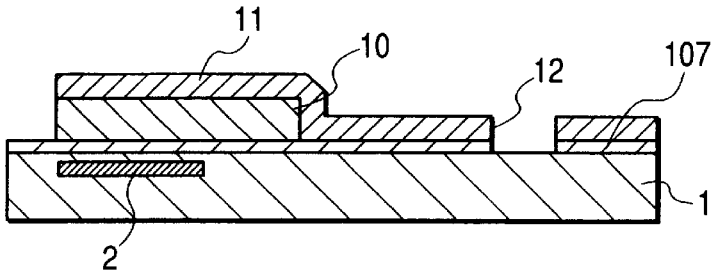

Next, as shown in FIG. 9B, after an SiN film 11 that is the second inorganic material film is formed using a plasma CVD method into the thickness of 2 μm on the anti-cavitation film 107 and the PSG film 10, it is patterned into a predetermined shape by a photolithography process and etching. After that, a through hole portion 12 to pierce the SiN film 11 and the anti-cavitation film 107 is formed by a photolithography process and etching.

Figure 9C:
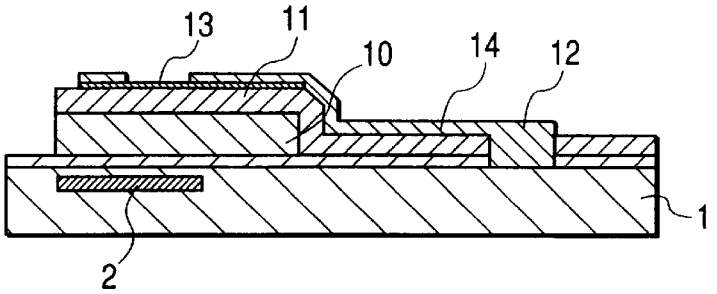

Next, as shown in FIG. 9C, an electrode portion 13 made of platinum (Pt) is formed into a 1000 Å thick film as a movable member side electrode, using a sputtering method on the portion of the SiN film 11 formed on the PSG film 10. Successively, an aluminum film 14 to be an interconnection layer for connecting the electrode portion 13 to a drive circuit (not shown) provided on the element substrate 1, is formed into the thickness of 0.5 μm using a sputtering method on the SiN film 11 and the electrode portion 13, and patterned by a photolithography process and etching.

Figure 9D:
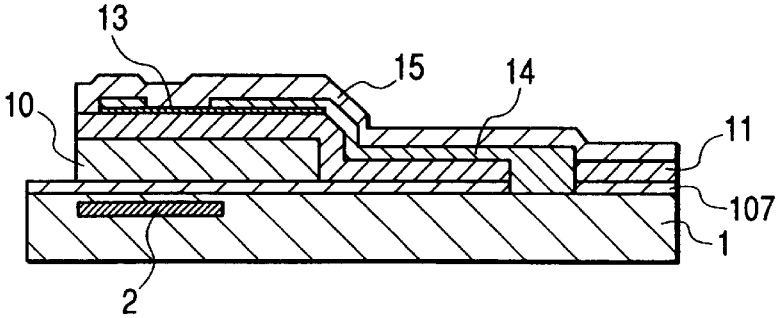

Next, as shown in FIG. 9D, an SiN film 15 that is the third inorganic material film is formed into the thickness of 2.5 μm using a plasma CVD method on the aluminum film 14, etc., and patterned by a photolithography process and etching.

Figure 9E:
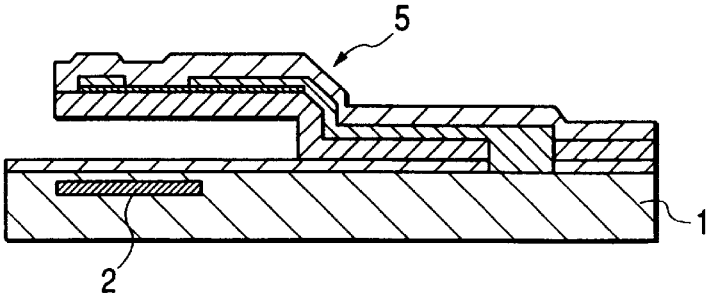

Lastly, by removing the PSG film 10 that is the first inorganic film, using a mixture aqueous solution of ammonia and fluoric acid, a movable member 5 is formed on the element substrate 1, as shown in FIG. 9E.

Note that, as the material of the first inorganic film, BPSG (Boron-doped Phospho-Silicate Glass), silicon oxide, or aluminum may also be used, other than PSG (Phospho-Silicate Glass).

Next, the fundamental concept of liquid discharge by the liquid discharge head according to the second embodiment of the present invention will be concretely described with reference to FIGS. 10A to 10E. FIGS. 10A to 10E are sectional views in a flow passage direction, for illustrating a discharge method by the liquid discharge head according to the second embodiment of the present invention.

As shown in FIGS. 10A to 10E, a discharge port 4 is disposed in an end portion region of a liquid flow passage 6, and a movable member 5 is disposed on the upstream side of the discharge port 4. The interior of the liquid flow passage 6 directly communicating with the discharge port 4 is filled with a liquid supplied from the common liquid chamber 7. Besides, on the heating body 2 generating a bubble, a metal film (anti-cavitation film 107) as a protection film protecting the heating body from a mechanical destruction mode such as cavitation or the like attendant upon generation and disappearance of the bubble, is formed, and this metal film is constructed so as to function as a GND electrode that is a substrate side electrode. The movable member 5 is displaceable by an electrostatic attraction generated between the GND electrode (anti-cavitation film 107) provided on the surface of the element substrate 1 and an electrode portion 13 provided on the movable member 5, and further, it is displaceable with growth and contraction of a bubble generated in a bubble generation area 9. Note that the movable member 5 is displaced to the element substrate 1 side by the above electrostatic attraction, and displaced to the top plate 3 side with the growth of the bubble.

Figure 10A:
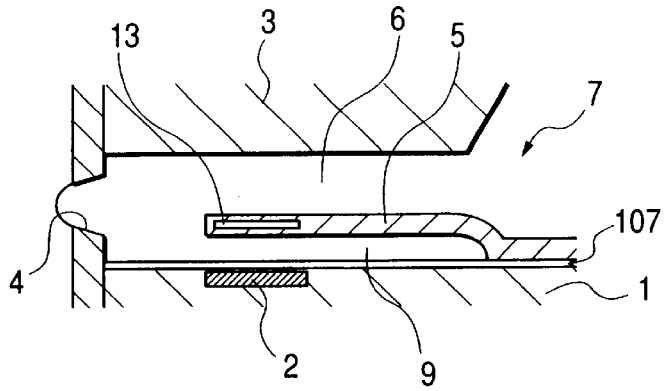
FIGS. 10A, 10B, 10C, 10D and 10E are typical sectional views in a flow passage direction, for illustrating a discharge method by the liquid discharge head according to the second embodiment of the present invention.

FIG. 10A shows the state that the meniscus of the liquid oscillating by discharging the liquid one after another, or the like, slightly protrudes from the discharge port 4.

Figure 10B:
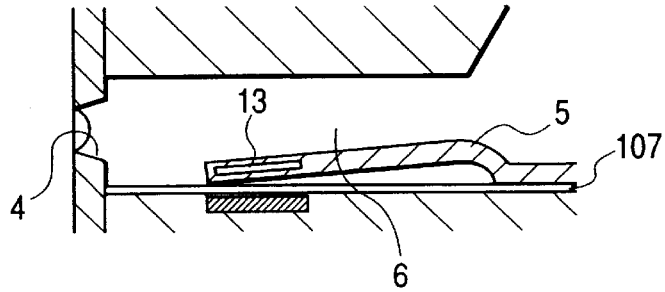

Next, by applying a voltage from the drive circuit of the element substrate 1 to the electrode portion 13 provided on the movable member 5 and grounding an electrode 107 on the element substrate 1, an electrostatic attraction is generated between both electrodes, and the movable member 5 is displaced to the element substrate 1 side, as shown in FIG. 10B. With that, the liquid surface of the liquid having protruded from the discharge port 4 becomes in the state of retreating within the liquid flow passage 6 by a certain distance. Thereby, it becomes possible to stabilize the liquid discharge quantity per each liquid discharge action. The electrostatic attraction acting at this time is shown by the following expression:

$$P=\in(V/d)^2$$

Here, P represents the electrostatic force [$N/m^2$], $\in$ represents the dielectric constant, V represents the applied voltage [V], and d represents the distance between the electrodes [m]. Note that it is preferable that the used liquid has a relatively high specific inductive capacity.

Figure 10C:
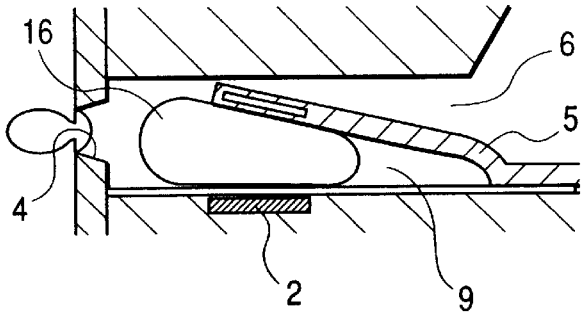

Next, as shown in FIG. 10C, when heat generation energy is given to the heating body 2 and the heating body 2 is rapidly heated, the surface of the heating body 2 contacting with the liquid in the bubble generation region 9 heats and bubbles the liquid. A bubble 16 generated by this heating and bubbling is a bubble based on a film boiling phenomenon as described in the U.S. Pat. No 4,723,129 specification, and generated with an extremely high pressure on the surface of the heating body 2 all at once. The pressure generated at this time becomes a pressure wave to be propagated in the liquid within the liquid flow passage 6, and acts on the movable member 5, and thereby, the movable member 5 is displaced to make the liquid in the liquid flow passage 6 fly from the discharge port 4. The bubble generated over the whole of the surface of the heating body 2 rapidly grows to be film-like, and, after that, the expansion of the bubble due to the extremely high pressure in the early stage of the generation continues to grow to the maximum bubbling diameter as the bubble 16 shown in FIG. 10C.

Figure 10D:
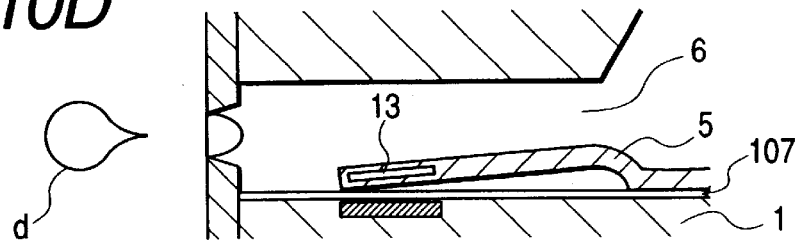

Next, by, the moment the flying liquid (droplet) separates from the liquid surface in the discharge port 4, applying a voltage to the electrode portion 13 provided on the movable member 5 and grounding the electrode 107 on the element substrate 1, an electrostatic attraction is generated between both electrodes, and the movable member 5 is displaced to the element substrate 1 side, as shown in FIG. 10D. By this action, the quantity of the liquid drawn back into the liquid flow passage 6 can be the same per each discharge action. Further, the phenomenon that the liquid near the discharge port 4 becomes a trailing shape so as to follow the flying liquid (droplet) d, and the phenomenon that small droplets, which are satellite droplets, fly after the main droplet, can be avoided.

Besides, by applying a voltage to the electrode portion 13 provided on the movable member 5 and grounding the electrode 107 on the element substrate 1 between the states shown in FIGS. 10C and 10D, the time from the state shown in FIG. 10C to the state shown in FIG. 10D, that is, the time since the movable member 5 is displaced to the top plate 3 side to the maximum till the movable member 5 is displaced to the element substrate 1 side can be shortened, and it becomes possible to improve the liquid discharge frequency.

Figure 10E:
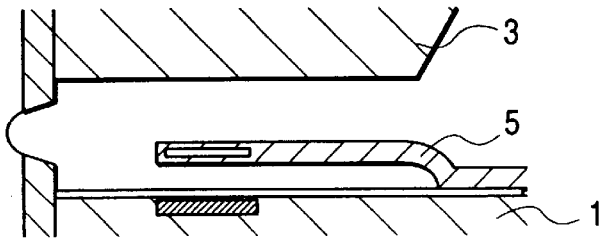

Lastly, when the movable member 5 returns to the original position by its own elastic force, the liquid discharge head becomes the initial state via the state of FIG. 10E.

Figure 11:
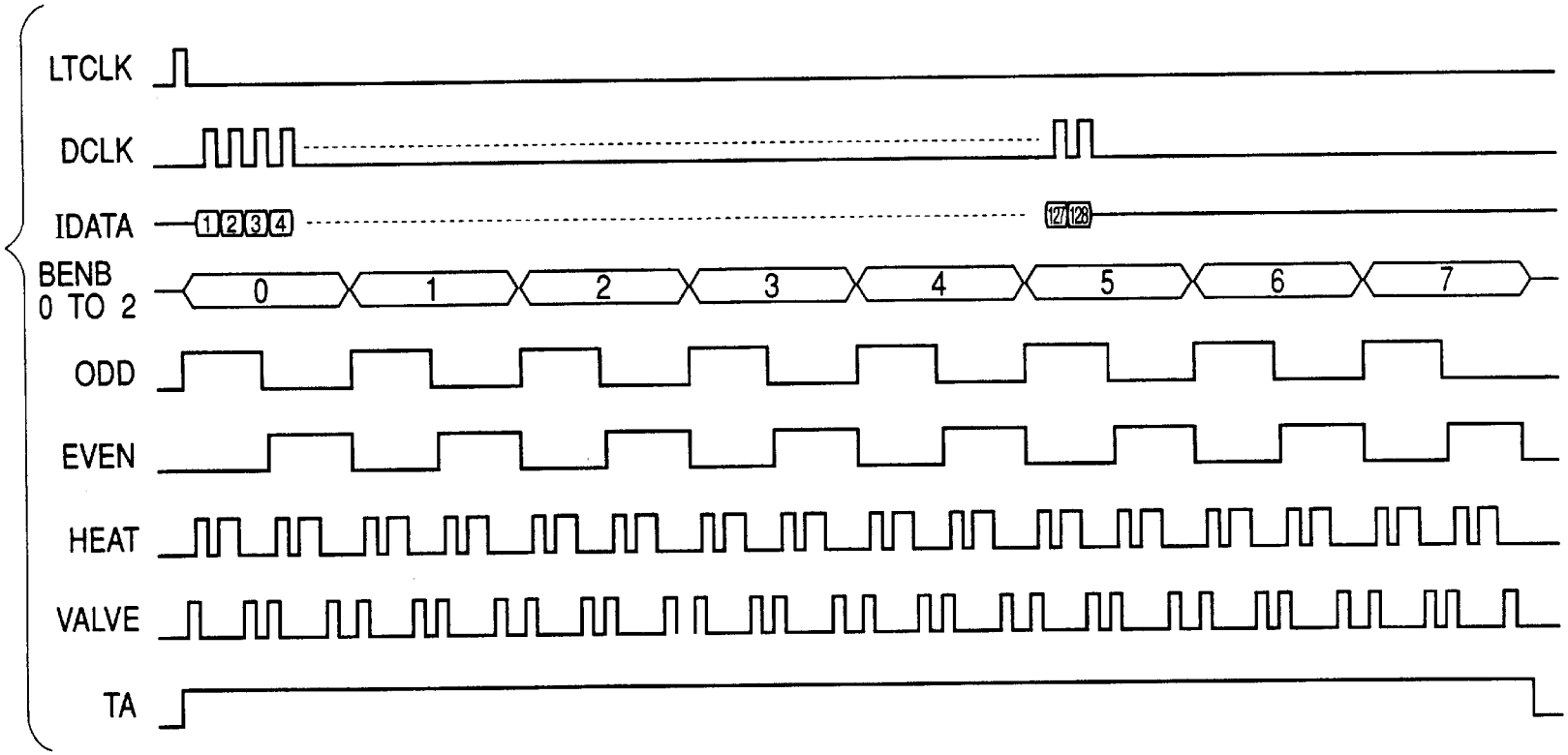
FIG. 11 is a timing chart of signals input to a heating body and an electrode portion or the like provided in the movable member, for executing the discharge principle according to the second embodiment of the present invention.

FIG. 11 shows a timing chart of signals input to the heating body 2 and the electrode portion 13 or the like provided in the movable member 5, for executing the discharge principle of the present invention shown in FIGS. 10A to 10E.

In this embodiment, at the first, a TA signal is set at the GND level. And, immediately before a preheat signal is applied, a VALVE signal is made at the high level (hereinafter, called "H level"), and set at the σH level. Thereby, the movable member 5 that is a valve is displaced to the heating body 2 side that is a heater, and retreats the meniscus in the discharge port. After that, by making the VALVE signal at the low level (hereinafter, called "L level") to discharge the charges of the valve and set the valve at the GND level, the valve is returned to the original position.

Next, by applying a main heat signal, a droplet is discharged from the discharge port. At this time, the valve serves to arrest the rearward growth of a bubble.

Next, the VALVE signal is made at the H level, and the valve is set at the σH level. Thereby, the valve is displaced to the heater side, and accelerates the refilling speed of the liquid to the liquid flow passage. After that, by making the VALVE signal at the L level to discharge the charges of the valve and set the valve at the GND level, the valve is returned to the original position.

Figure 12:
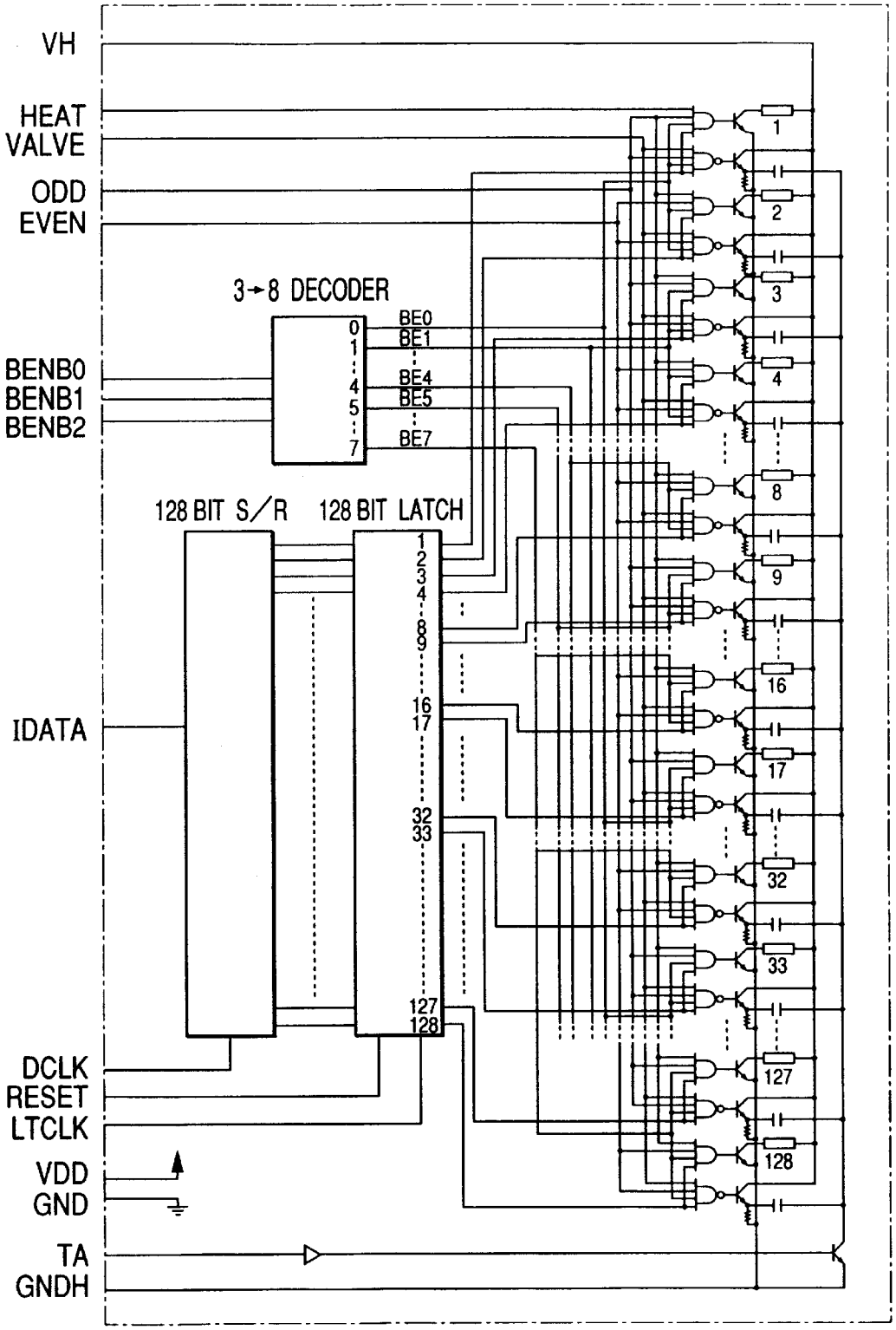
FIG. 12 is an equivalent circuit diagram of an electric circuit constructed on an element substrate according to the second embodiment of the present invention.

FIG. 12 is an equivalent circuit of an electric circuit constructed on the element substrate, which comprises, other than the heating body 2 in the liquid flow passage constituting one nozzle, the electrode portion 13 provided in the movable member 5, and drive transistors driving them individually, a shift register for drive signal processing, a latch circuit maintaining data, and an AND circuit connected to each transistor. The AND circuit logically calculates a block selection signal for block-dividing an ink flow passage constituting a nozzle, a valve signal applied to each movable member 5, and a drive pulse signal applied to those data and each heating body 2, and drives the corresponding transistor on the basis of the calculation result. Besides, the TA signal that is a common electrode is normally open, and driven to the ground in correspondence to the valve signal applied to the movable member 5.

Figure 13:
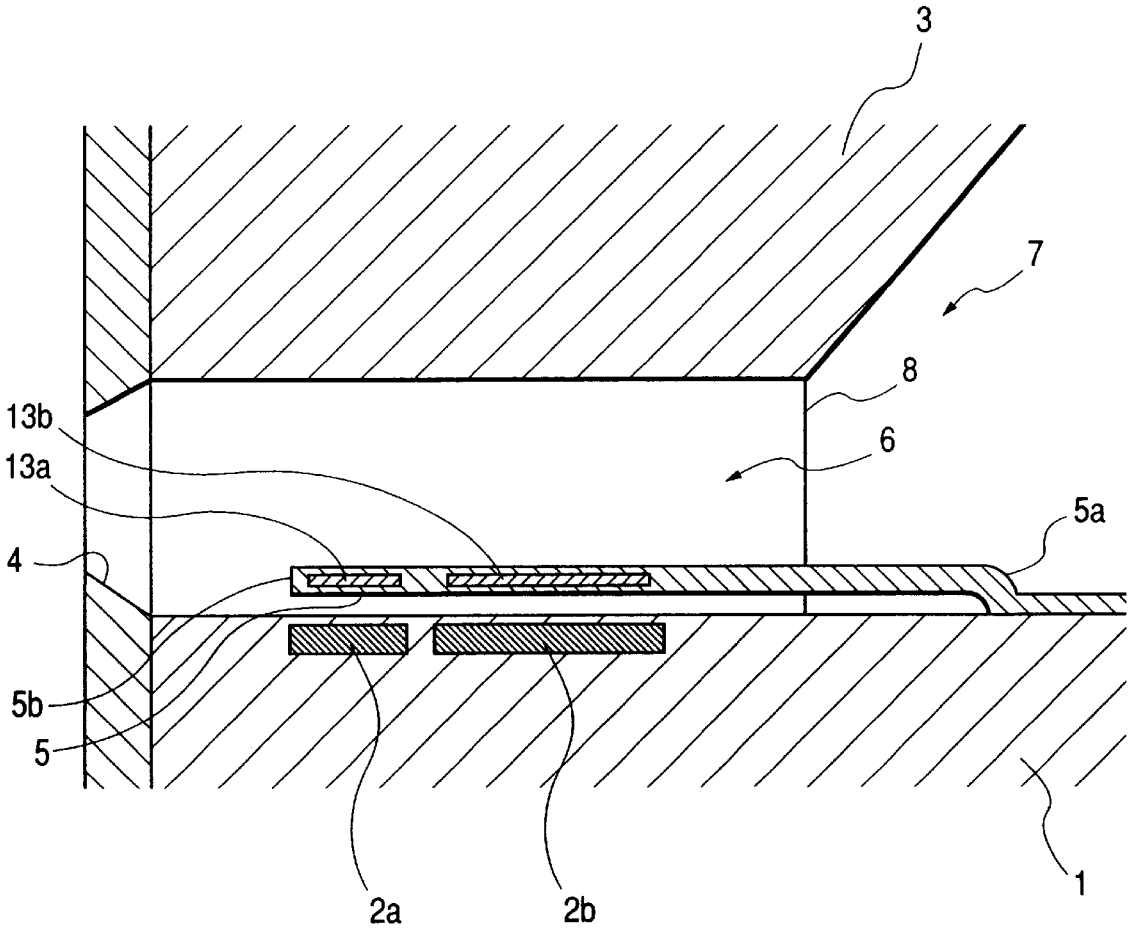
FIG. 13 is a typical sectional view along a liquid flow passage direction, for illustrating the fundamental structure of the third embodiment of a liquid discharge head of the present invention.
Figure 14:
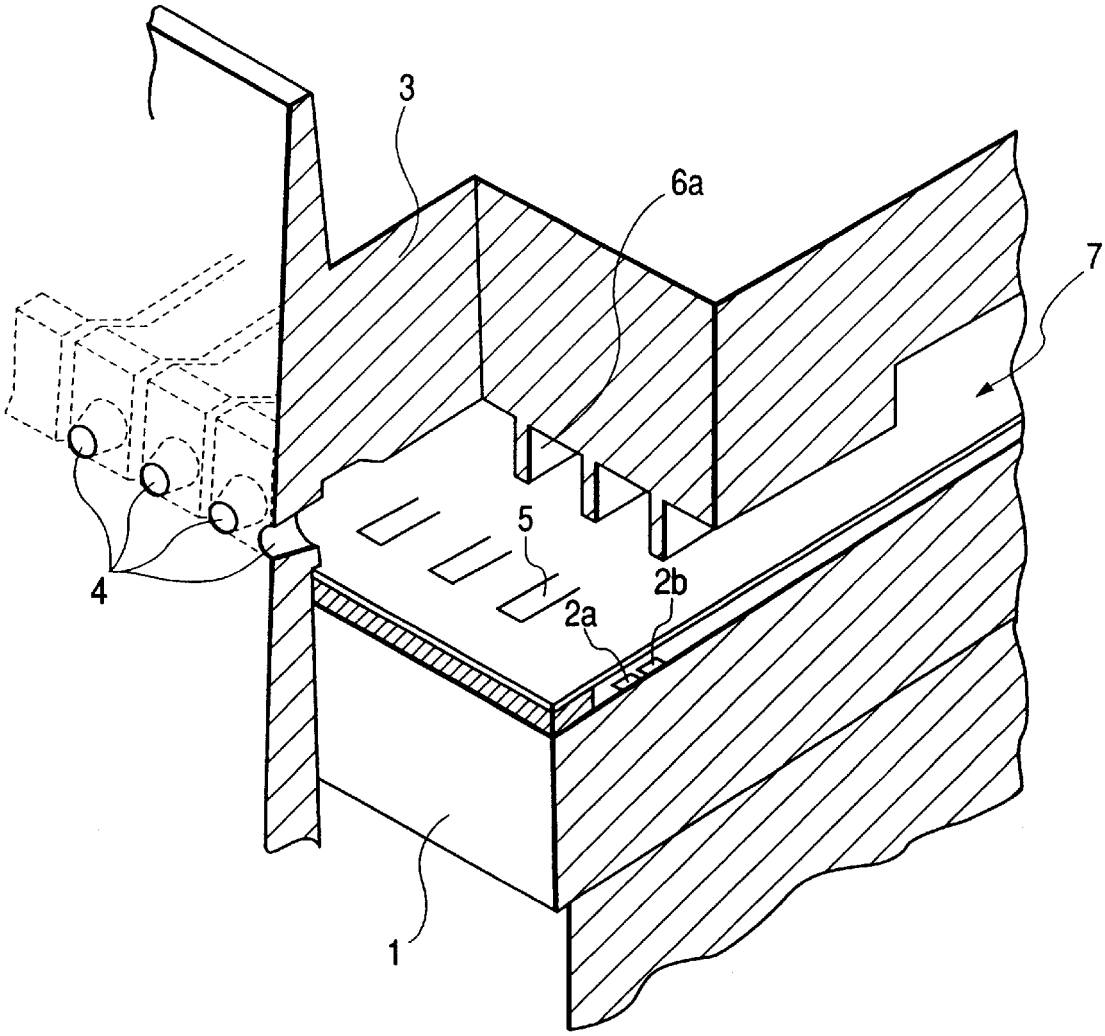
FIG. 14 is a typical perspective view showing by cutting off part of the liquid discharge head.

FIG. 13 is a sectional view along a liquid flow passage direction, for illustrating the fundamental structure of an embodiment of a liquid discharge head of the present invention, and FIG. 14 is a perspective view showing by cutting off part of the liquid discharge head shown in FIG. 13. A liquid discharge head of this embodiment has an element substrate 1 on which two heating bodies 2*a* and 2*b* that are bubble generation elements giving a liquid thermal energy for generating a bubble, are provided as a set in parallel, and a top plate 3 joined onto this element substrate 1.

The element substrate 1 is that a silicon oxide film or a silicon nitride film aiming at insulating and heat storage is formed on a base body such as silicon or the like, and an electric resistance layer constituting the heating bodies 2*a* and 2*b* and an interconnection electrode are patterned thereon. The heating bodies 2*a* and 2*b* generate heat by applying a voltage from this interconnection electrode to the electric resistance layer and flowing a current in the electric resistance layer.

The top plate 3 is for constructing a plurality of liquid flow passages 6 corresponding to each set of heating bodies 2*a* and 2*b* and a common liquid chamber 7 for supplying a liquid to each liquid flow passage 6, and a flow passage side wall 8 extending from the roof portion between the heating bodies 2*a* and 2*b* of each set is integrally provided. The top plate 3 is made of silicon type material, and can be formed by forming a pattern of the liquid flow passages 6 and the common liquid chamber 8 by etching, or, after depositing a material to be the flow passage side wall 8 such as silicon nitride or silicon oxide, by a known film formation method such as CVD or the like, on a silicon substrate, etching the portion of the liquid flow passages 6.

A wall portion is provided on a tip end surface of the top plate 3, and a plurality of discharge ports 4 (see FIG. 14) which correspond to each liquid flow passage 6 and communicate with the common liquid chamber 7 via the liquid flow passages 6, respectively, is formed in this wall portion.

Further, in this liquid discharge head, a cantilever-like movable member 5 disposed to face the heating bodies 2*a* and 2*b* is provided. The movable member 5 is made of a thin film of a silicon type material such as silicon nitride or silicon oxide, or nickel which is excellent in elasticity.

This movable member 5 is disposed at a position facing the heating bodies 2*a* and 2*b* in a state of covering the heating bodies 2*a* and 2*b* at a predetermined distance from the heating bodies 2*a* and 2*b*, so as to have a fulcrum 5*a* on the upstream side of a big flow flowing from the common liquid chamber 7 via the upper part of the movable member 5 to the discharge port 4 side by a discharge action of a liquid, and near the support fixture portion of the movable member 5 to the element substrate 1, and further a free end 5*b* on the downstream side in relation to this fulcrum 5*a*. This space between the heating bodies 2*a* and 2*b* and the movable member 5 becomes a bubble generation region 9.

Next, a manufacturing method of the movable member of the liquid discharge head of this embodiment will be described with reference to FIGS. 15A to 15E. FIGS. 15A to 15E are sectional views along a liquid flow passage direction, showing manufacturing steps of the movable member in the liquid discharge head shown in FIG. 13.

Figure 15A:
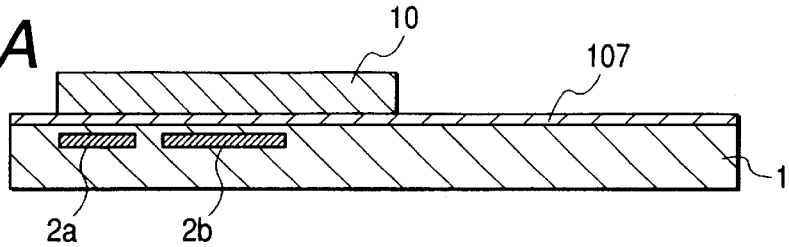
FIGS. 15A, 15B, 15C, 15D and 15E are typical sectional views along a liquid flow passage direction, showing manufacturing steps of a movable member in a liquid discharge head according to the third embodiment of the present invention.

First, as shown in FIG. 15A, after a PSG film 10 that is the first inorganic material film is formed using a plasma CVD method into the thickness of 5 μm on the anti-cavitation film 107 of the element substrate 1, patterning into a predetermined shape is performed by a photolithography process and etching.

Figure 15B:
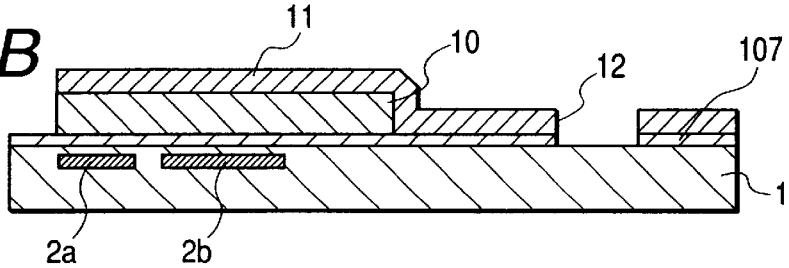

Next, as shown in FIG. 15B, after an SiN film 11 that is the second inorganic material film is formed using a plasma CVD method into the thickness of 2μm on the anti-cavitation film 107 and the PSG film 10, it is patterned into a predetermined shape by a photolithography process and etching. After that, a through hole portion 12 to pierce the SiN film 11 and the anti-cavitation film 107 is formed by a photolithography process and etching.

Figure 15C:
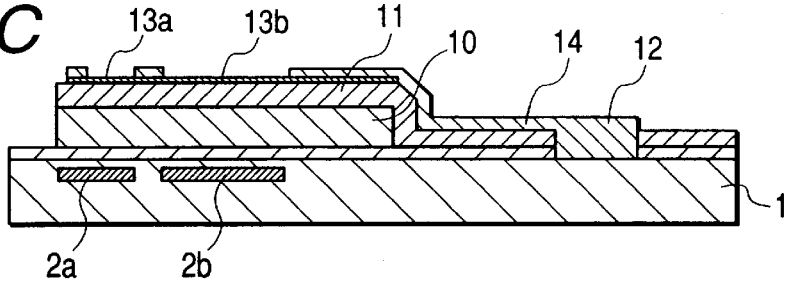

Next, as shown in FIG. 15C, a first electrode portion 13*a* and a second electrode portion 13*b* made of platinum (Pt) are formed into 1000 Å thick films as movable member side electrodes, using a sputtering method on the portion of the SiN film 11 formed on the PSG film 10. Successively, an aluminum film 14 to be an interconnection layer for connecting between a drive circuit (not shown) formed on the element substrate 1 and the electrode portions 13*a* and 13*b*, is formed into the thickness of 0.5 μm using a sputtering method on the SiN film 11 and the electrode portions 13*a* and 13*b*, and patterned by a photolithography process and etching.

Figure 15D:
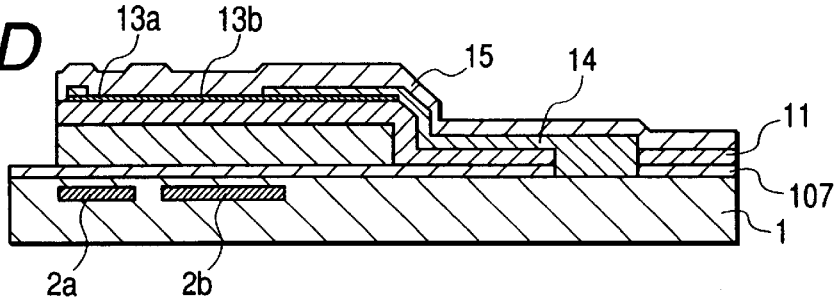

Next, as shown in FIG. 15D, an SiN film 15 that is the third inorganic material film is formed into the thickness of 2.5 μm using a plasma CVD method on the aluminum film 14, etc., and patterned by a photolithography process and etching.

Figure 15E:
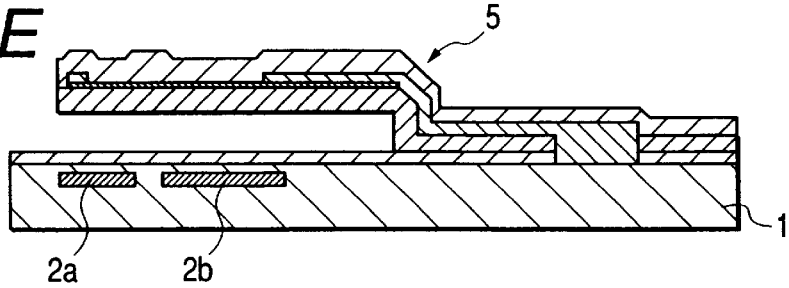

Lastly, by removing the PSG film 10 that is the first inorganic film, using a mixture aqueous solution of ammonia and fluoric acid, a movable member 5 is formed on the element substrate 1, as shown in FIG. 15E.

Note that, as the material of the first inorganic film, BPSG (Boron-doped Phospho-Silicate Glass), silicon oxide, or aluminum may also be used, other than PSG (Phospho-Silicate Glass).

Next, the fundamental concept of liquid discharge by the liquid discharge head according to the third embodiment of the present invention will be concretely described with reference to FIGS. 16A to 16E and 17A to 17E. FIGS. 16A to 16E are sectional views in a flow passage direction, for illustrating the first discharge method by the liquid discharge head according to the third embodiment of the present invention.

As shown in FIGS. 16A to 16E, a discharge port 4 is disposed in an end portion region of a liquid flow passage 6, and a movable member 5 is disposed on the upstream side of the discharge port 4. The interior of the liquid flow passage 6 directly communicating with the discharge port 4 is filled with a liquid supplied from the common liquid chamber 7. Besides, on the heating bodies 2*a* and 2*b* generating a bubble, a metal film (anti-cavitation film 107) as a protection film protecting the heating body from a mechanical destruction mode such as cavitation or the like attendant upon generation and disappearance of the bubble, is formed, and this metal film is constructed so as to function as a GND electrode that is a substrate side electrode. The movable member 5 is displaceable by an electrostatic attraction generated between the GND electrode (anti-cavitation film 107) provided on the surface of the element substrate 1 and an electrode portion 13 provided on the movable member 5, and further, it is displaceable with growth and contraction of a bubble generated in a bubble generation area 9. Note that the movable member 5 is displaced to the element substrate 1 side by the above electrostatic attraction, and displaced to the top plate 3 side with the growth of the bubble.

Figure 16A:
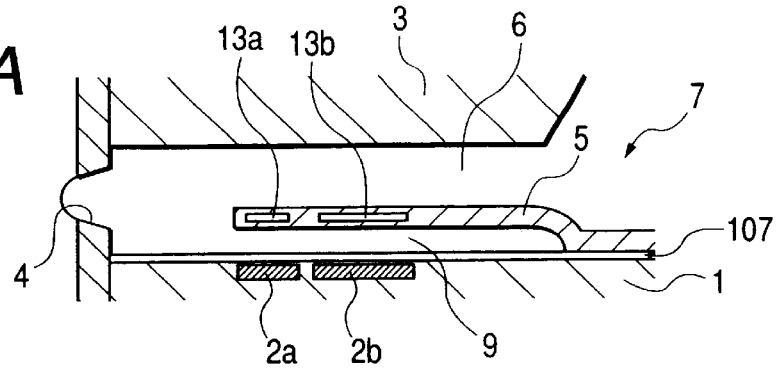
FIGS. 16A, 16B, 16C, 16D and 16E are typical sectional views in a flow passage direction, for illustrating the first discharge method by the liquid discharge head according to the third embodiment of the present invention.

FIG. 16A shows the state that the meniscus of the liquid oscillating by discharging the liquid one after another, or the like, slightly protrudes from the discharge port 4.

Figure 16B:
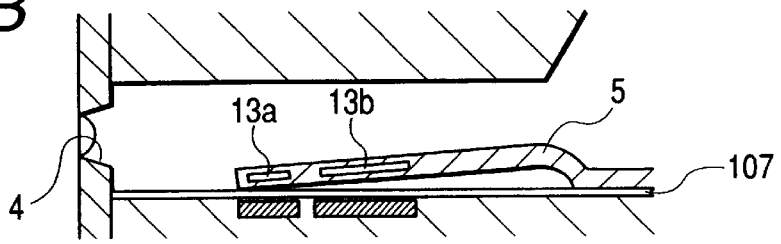

Next, by applying a voltage to the first electrode portion 13*a* provided on the movable member 5 and grounding an electrode 107 on the element substrate 1, an electrostatic attraction is generated between both electrodes, and the movable member 5 is displaced to the element substrate 1 side, as shown in FIG. 16B. With that, the liquid surface of the liquid having protruded from the discharge port 4 becomes in the state of retreating within the liquid flow passage 6 by a certain distance. Thereby, it becomes possible to stabilize the liquid discharge quantity per each liquid discharge action. The electrostatic attraction acting at this time is shown by the following expression:

$$P=\in(V/d)^2$$

Here, P represents the electrostatic force [$N/m^2$], $\in$ represents the dielectric constant, V represents the applied voltage [V], and d represents the distance between the electrodes [m]. Note that it is preferable that the used liquid has a relatively high specific inductive capacity.

Figure 16C:
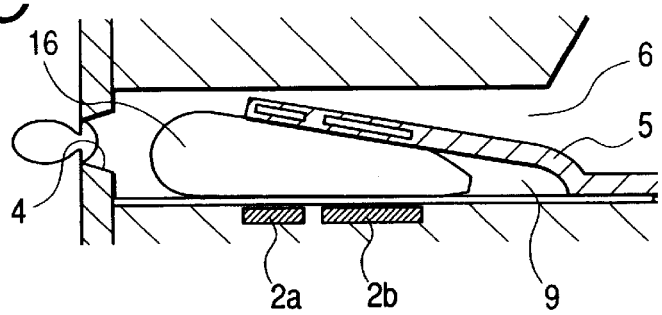

Next, as shown in FIG. 16C, when heat generation energy is given to both the heating bodies 2*a* and 2*b* and the heating bodies 2*a* and 2*b* are rapidly heated, the surfaces of the heating bodies 2*a* and 2*b* contacting with the liquid in the bubble generation region 9 heat and bubble the liquid. A bubble 16 generated by this heating and bubbling is a bubble based on a film boiling phenomenon as described in the U.S. Pat. No. 4,723,129 specification, and generated with an extremely high pressure on the surfaces of the heating bodies 2*a* and 2*b* all at once. The pressure generated at this time becomes a pressure wave to be propagated in the liquid within the liquid flow passage 6, and acts on the movable member 5, and thereby, the movable member 5 is displaced around the fulcrum 5*a* to make the liquid in the liquid flow passage 6 fly from the discharge port 4. The bubble generated over the whole of the surfaces of the heating bodies 2*a* and 2*b* rapidly grows to be film-like, and after that, the expansion of the bubble due to the extremely high pressure in the early stage of the generation continues to grow to the maximum bubbling diameter as the bubble 16 shown in FIG. 16C.

Figure 16D:
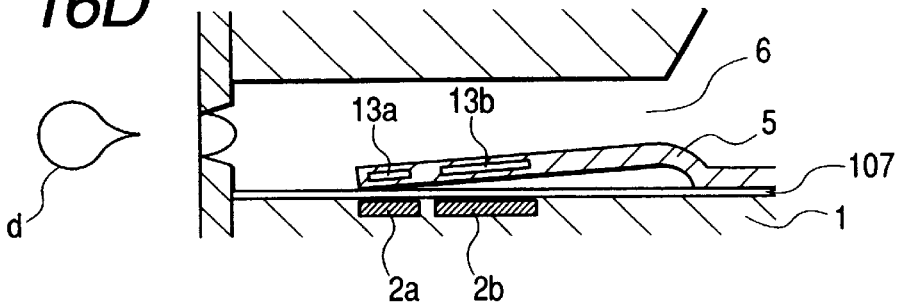

Next, by, the moment the flying liquid (droplet) separates from the liquid surface in the discharge port 4, applying a voltage to the first electrode portion 13*a* provided on the movable member 5 and grounding the electrode 107 on the element substrate 1, an electrostatic attraction is generated between both electrodes, and the movable member 5 is displaced to the element substrate 1 side, as shown in FIG. 16D. By this action, the quantity of the liquid drawn back into the liquid flow passage 6 can be the same per each discharge action. Further, the phenomenon that the liquid near the discharge port 4 becomes a trailing shape so as to follow the flying liquid (droplet) d, and the phenomenon that small droplets, which are satellite droplets, fly after the main droplet, can be avoided.

Besides, by applying a voltage to the electrode portions 13*a* and 13*b* provided on the movable member 5 and grounding the electrode 107 on the element substrate 1 between the states shown in FIGS. 16C and 16D, the time from the state shown in FIG. 16C to the state shown in FIG. 16D, that is, the time since the movable member 5 is displaced to the top plate 3 side to the maximum till the movable member 5 is displaced to the element substrate 1 side can be shortened, and it becomes possible to improve the liquid discharge frequency.

Figure 16E:
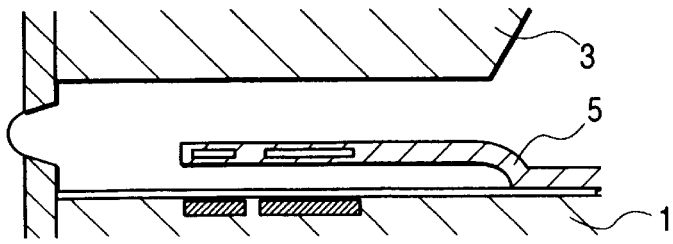

Lastly, when the movable member 5 returns to the original position by its own elastic force, the liquid discharge head becomes the initial state via the state of FIG. 16E.

FIGS. 17A to 17E are sectional views in a flow passage direction, for illustrating the second discharge method by the liquid discharge head according to the third embodiment of the present invention.

Figure 17A:
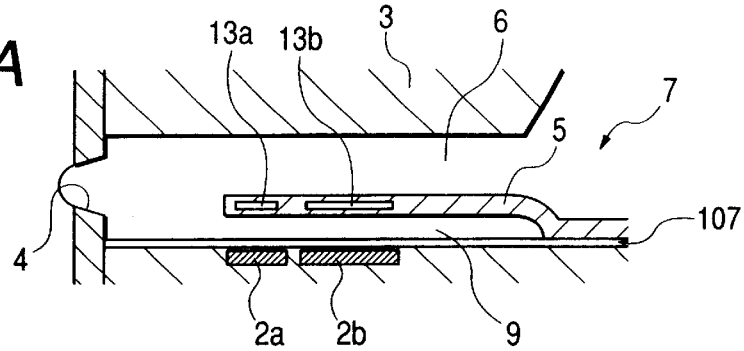
FIGS. 17A, 17B, 17C, 17D and 17E are typical sectional views in a flow passage direction, for illustrating the second discharge method by the liquid discharge head according to the third embodiment of the present invention.

FIG. 17A shows the state that the meniscus of the liquid oscillating by discharging the liquid one after another, or the like, slightly protrudes from the discharge port 4.

Figure 17B:
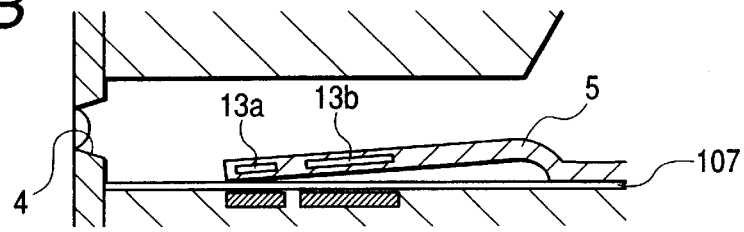

Next, by applying a voltage to the first electrode portion 13*a* provided on the movable member 5 and grounding an electrode 107 on the element substrate 1, an electrostatic attraction is generated between both electrodes, and the movable member 5 is displaced to the element substrate 1 side, as shown in FIG. 17B. With that, the liquid surface of the liquid having protruded from the discharge port 4 becomes in the state of retreating within the liquid flow passage 6 by a certain distance. Thereby, it becomes possible to stabilize the liquid discharge quantity per each liquid discharge action. The electrostatic attraction acting at this time is shown by the following expression:

$$P=\in(V/d)^2$$

Here, P represents the electrostatic force [$N/m^2$], $\in$ represents the dielectric constant, V represents the applied voltage [V], and d represents the distance between the electrodes [m]. Note that it is preferable that the used liquid has a relatively high specific inductive capacity.

Figure 17C:
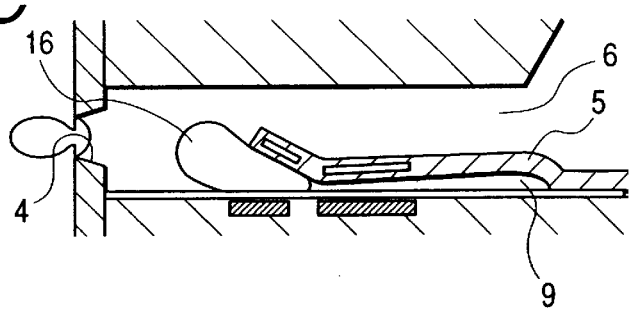

Next, as shown in FIG. 17C, by applying a voltage to the second electrode portion 13*b* provided on the movable member 5 and grounding an electrode 107 on the element substrate 1, an electrostatic attraction is generated between both electrodes. Simultaneously with this, when heat generation energy is given to the first heating body 2*a* and the heating body 2*a* is rapidly heated, the surface of the first heating body 2*a* contacting with the liquid in the bubble generation region 9 heats and bubbles the liquid. A bubble 16 generated by this heating and bubbling is a bubble based on a film boiling phenomenon as described in the U.S. Pat. No 4,723,129 specification, and generated with an extremely high pressure on the surface of the heating body 2 all at once. The pressure generated at this time becomes a pressure wave to be propagated in the liquid within the liquid flow passage 6, and acts on the movable member 5, and thereby, the movable member 5 is displaced around the portion between the electrode portions 13*a* and 13*b* adjacent to each other, to make the liquid in the liquid flow passage 6 fly from the discharge port 4. The bubble generated over the whole of the surface of the heating body 2*a* rapidly grows to be film-like, and after that, the expansion of the bubble due to the extremely high pressure in the early stage of the generation continues to grow to the maximum bubbling diameter as the bubble 16 shown in FIG. 17C.

Figure 17D:
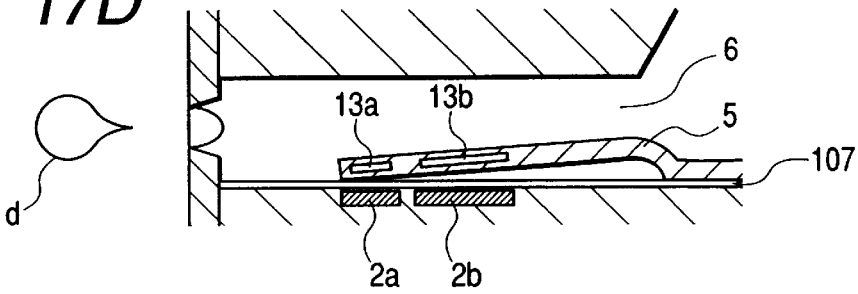

Next, by, the moment the flying liquid (droplet) separates from the liquid surface in the discharge port 4, applying a voltage to the first electrode portion 13*a* provided on the movable member 5 and grounding the electrode 107 on the element substrate 1, an electrostatic attraction is generated between both electrodes, and the movable member 5 is displaced to the element substrate 1 side, as shown in FIG. 17D. By this action, the quantity of the liquid drawn back into the liquid flow passage 6 can be the same per each discharge action. Further, the phenomenon that the liquid near the discharge port 4 becomes a trailing shape so as to follow the flying liquid (droplet) d, and the phenomenon that small droplets, which are satellite droplets, fly after the main droplet, can be avoided.

Besides, by applying a voltage to the electrode portions 13*a* and 13*b* provided on the movable member 5 and grounding the electrode 107 on the element substrate 1 between the states shown in FIGS. 17C and 17D, the time from the state shown in FIG. 17C to the state shown in FIG. 17D, that is, the time since the movable member 5 is displaced to the top plate 3 side to the maximum till the movable member 5 is displaced to the element substrate 1 side can be shortened, and it becomes possible to improve the liquid discharge frequency.

Figure 17E:
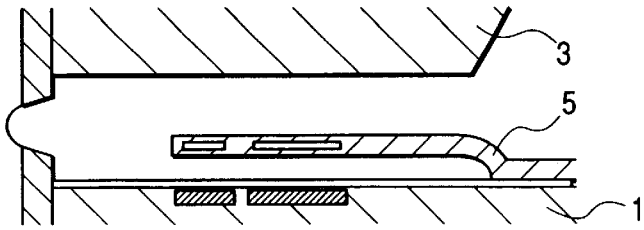

Lastly, when the movable member 5 returns to the original position by its own elastic force, the liquid discharge head becomes the initial state via the state of FIG. 17E.

In this manner, by changing the distance of the displacement fulcrum of the movable member 5 from the free end 5*b* at the desire, and setting the generation region of the bubble 16 to the region in which the portion from the free end 5*b* to the displacement fulcrum of the movable member 5 is displaced, it becomes possible to change the volume of the droplet discharged from the discharge port, at the desire.

Note that, although the construction in which an electrostatic attraction is generated between the electrode portions 13*a* and 13*b* provided on the movable member 5 and the electrode 107 on the element substrate 1 and the movable member 5 is displaced to the element substrate 1 side, in the above, as a construction for generating an electrostatic attraction between the movable member side electrode and the element substrate, other than this construction, it may be a construction in which an electrostatic attraction is generated between the electrode portions 13*a* and 13*b* provided on the movable member 5 and the heating bodies 2*a* and 2*b* provided on the element substrate. In this case, it is preferable to be a construction in which a voltage is applied to the heating bodies 2*a* and 2*b* and the electrode portions 13*a* and 13*b* are grounded. As the material of the anti-cavitation film 107 in this case, for strengthening the electrostatic force between the heating bodies and the movable member, it is preferable to use an amorphous metal, which is weaker in conductivity than a metal film. Otherwise, as the material of the anti-cavitation film 107, nitride (BN, TiN), carbide (WC, TiC, BC) or the like, which are insulating materials that are further weaker in conductivity and relatively high in specific inductive capacity, may also be used.

Figure 18:
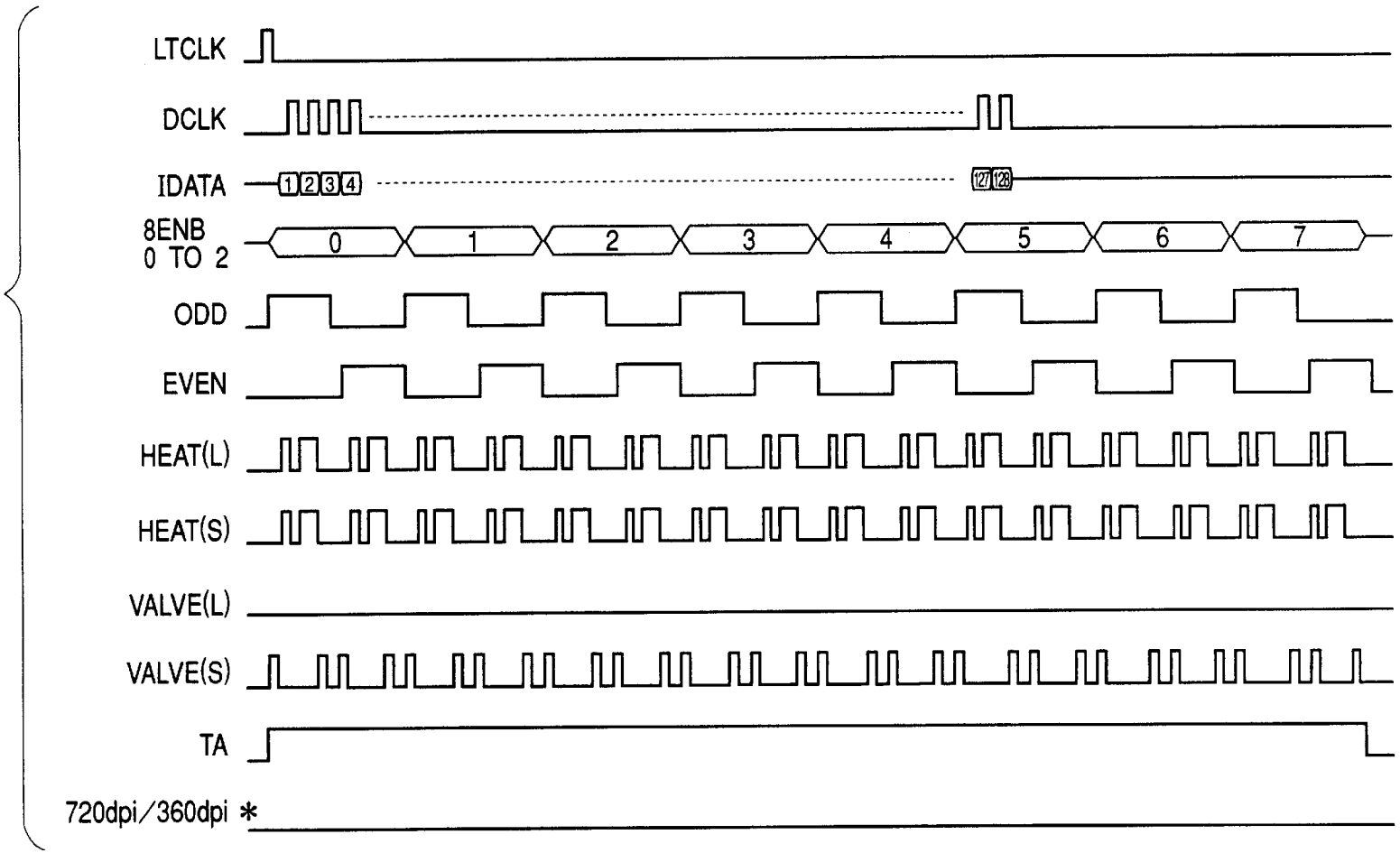
FIG. 18 is a timing chart of signals input to a heating body and an electrode portion or the like provided in the movable member, for executing the discharge principle according to the third embodiment of the present invention.
Figure 19:
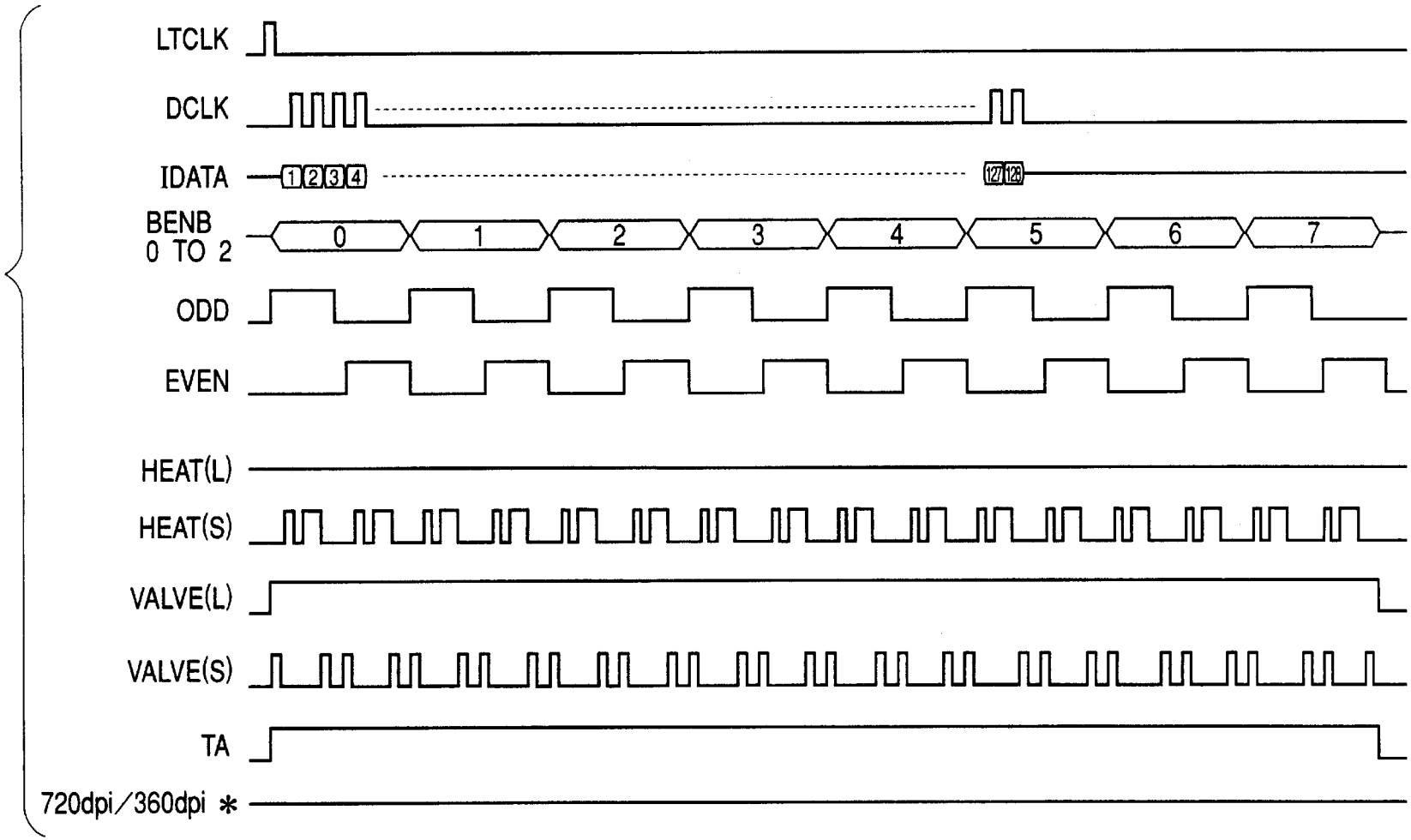
FIG. 19 is a timing chart of signals input to a heating body and an electrode portion or the like provided in the movable member, for executing the discharge principle according to the third embodiment of the present invention.

FIGS. 18 and 19 show timing charts of signals input to the heating bodies and the electrode portions or the like provided in the movable members, for executing the discharge principles according to the third embodiment of the present invention shown in FIGS. 16A to 16E and 17A to 17E, respectively.

In the example shown in FIG. 18, at the first, a TA signal is set at the GND level. And, immediately before a preheat signal is applied to the large heater (second heating body 2*b*) and the small heater (first heating body 2*a*), the first electrode portion 13*a* that is the front side electrode (S) is made at the high level (hereinafter, called "H level"), and the valve (movable member 5) is set at the σH level. Thereby, the valve is displaced to the heater side, and retreats the meniscus in the discharge port. After that, by making the front side electrode (S) at the low level (hereinafter, called "L level") to discharge the charges of the valve and set the valve at the GND level, the valve is returned to the original position.

Next, by applying a main heat signal to the large and small heaters at the same time, a droplet of a large discharge quantity is discharged from the discharge port. At this time, the valve serves to arrest the rearward growth of a bubble.

Next, the front side electrode (S) is made at the H level, and the valve is set at the σH level. Thereby, the valve is displaced to the heater side, and accelerates the refilling speed of the liquid to the liquid flow passage. After that, by making the front side electrode (S) at the L level to discharge the charges of the valve and set the valve at the GND level, the valve is returned to the original position.

On the other hand, in the example shown in FIG. 19, a TA signal is set at the GND level, and further, the second electrode portion 13*b* that is the rear side electrode (L) is also made at the GND level. Thereby, the portion on the rear side electrode (L) side of the valve is displaced to the large heater (second heating body 2*b*) side. And, immediately before a preheat signal is applied to the small heater (first heating body 2*a*), the first electrode portion 13*a* that is the front side electrode (S) is made at the H level, and the valve is made at the σH level. Thereby, the valve is displaced to the heater side, and retreats the meniscus in the discharge port. After that, by making the front side electrode (S) at the L level to discharge the charges of the valve and set the valve at the GND level, the valve is returned to the original position.

Next, by applying a main heat signal to only the small heater at the same time, a droplet of a small discharge quantity is discharged from the discharge port. At this time, the valve serves to arrest the rearward growth of a bubble.

Next, the front side electrode (S) is made at the H level, and the valve is set at the σH level. Thereby, the valve is displaced to the heater side, and accelerates the refilling speed of the liquid to the liquid flow passage. After that, by making the front side electrode (S) at the L level to discharge the charges of the valve and set the valve at the GND level, the valve is returned to the original position.

Figure 20:
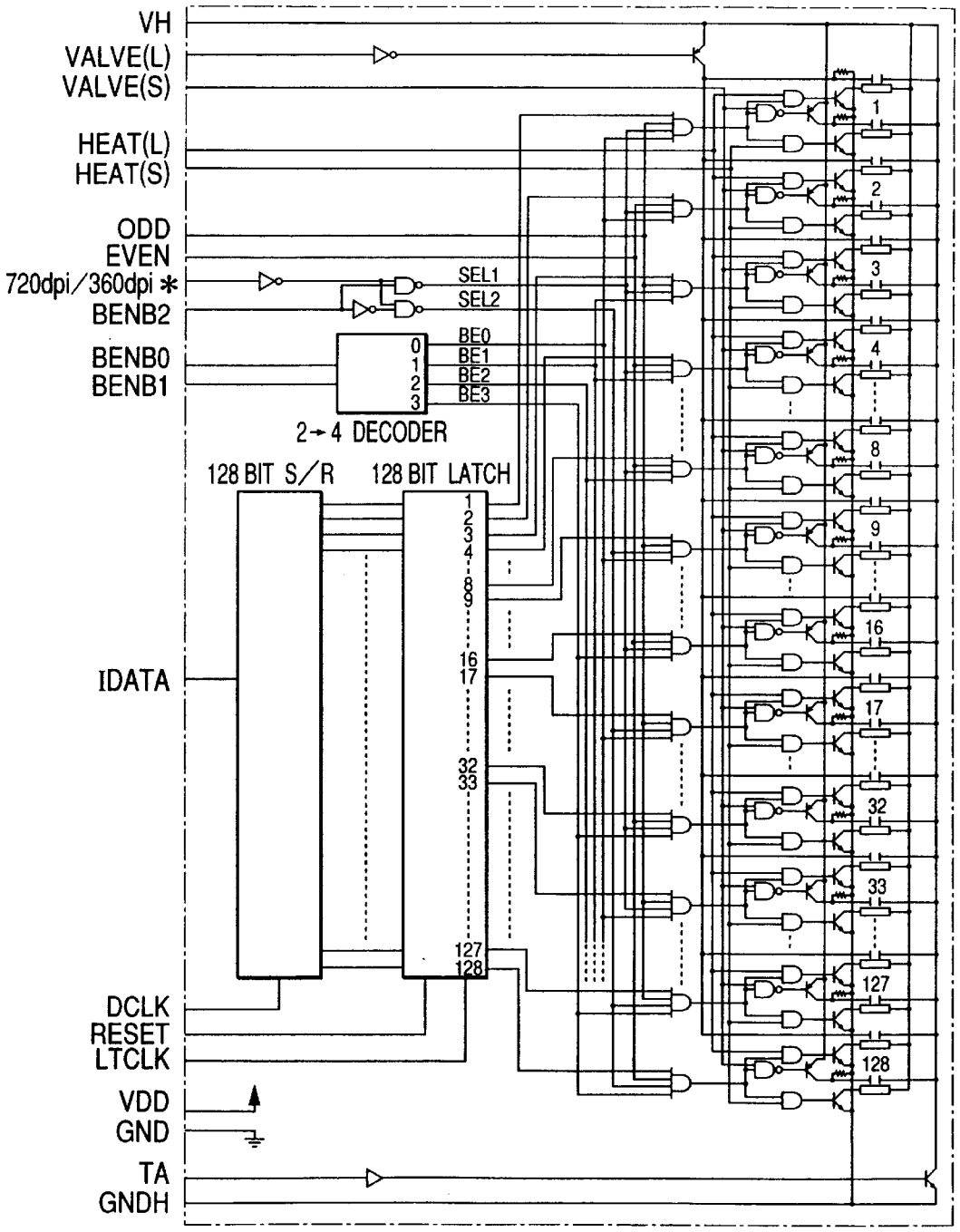
FIG. 20 is an equivalent circuit diagram of an electric circuit constructed on an element substrate according to the third embodiment of the present invention.

FIG. 20 is an equivalent circuit of an electric circuit constructed on the element substrate, which comprises, other than two heating bodies 2*a* and 2*b* in the liquid flow passage constituting one nozzle, two electrode portions 13*a* and 13*b* provided in the movable member 5, and drive transistors driving them individually, a shift register for drive signal processing, a latch circuit maintaining data, and an AND circuit connected to each transistor. The AND circuit logically calculates a block selection signal for block-dividing an ink flow passage constituting a nozzle, a select signal, a valve signal applied to two electrode portions 13*a* and 13*b* of each movable member 5, and a drive pulse signal applied to those data and each heating body, and drives the corresponding transistor on the basis of the calculation result. Besides, the Ta signal that is a common electrode is normally open, and driven to the ground in correspondence to drive.

Figure 21:
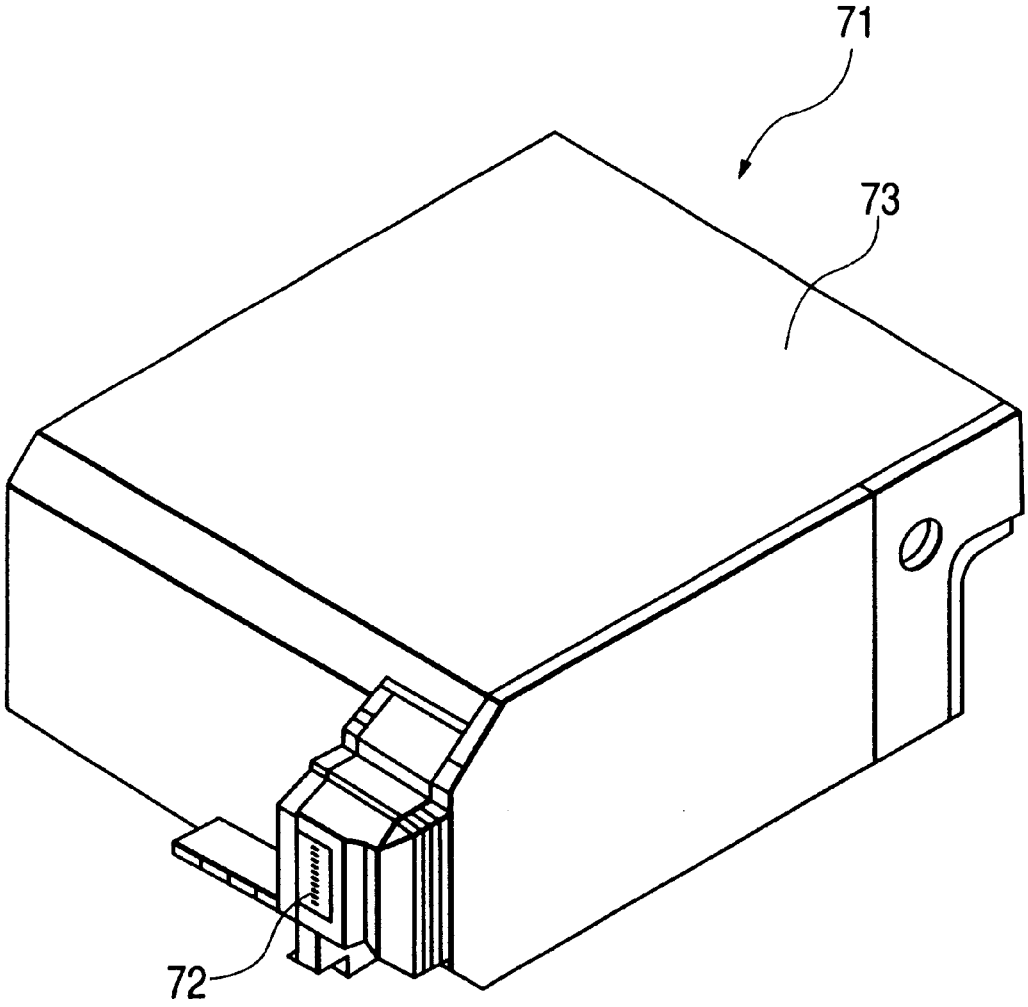
FIG. 21 is a typical perspective view showing a liquid discharge head cartridge on which a liquid discharge head of the present invention is loaded.

Next, a liquid discharge head cartridge on which the liquid discharge head described above is loaded will be briefly described with reference to FIG. 21. FIG. 21 is a perspective view showing a liquid discharge head cartridge on which the above-mentioned liquid discharge head is loaded.

The liquid discharge head cartridge 71 of this embodiment has the above-mentioned liquid discharge head 72, and a liquid container 73 accommodating a liquid such as an ink or the like supplied to the liquid discharge head 72. The liquid accommodated in the liquid container 73 is supplied to the common liquid chamber 7 (see FIG. 3) of the liquid discharge head 72 through a not-shown liquid supply passage.

Note that this liquid container 73 may be used by being refilled with the liquid after consumption of the liquid. For this, it is preferable to provide a liquid injection port to the liquid container 73. Besides, the liquid discharge head 72 and the liquid container 73 may be one body, or separable.

Figure 22:
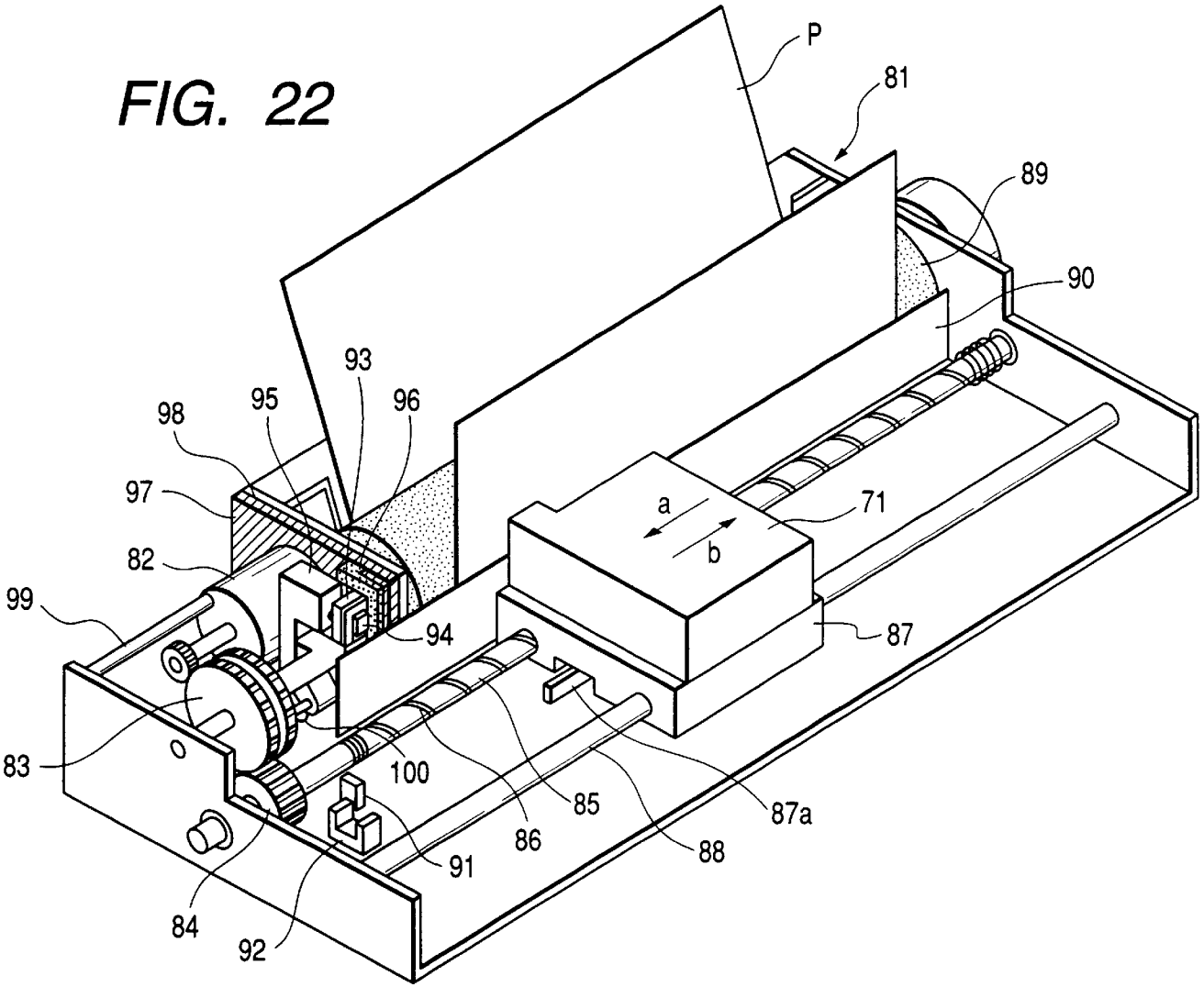
FIG. 22 is a typical perspective view showing the principal part of a liquid discharge device on which a liquid discharge head of the present invention is loaded.

Next, a liquid discharge device on which the liquid discharge head described above is loaded will be described with reference to FIG. 22. FIG. 22 is a perspective view showing the principal part of a liquid discharge device on which the above-mentioned liquid discharge head is loaded.

The liquid discharge device 81 of this embodiment is that the liquid discharge head cartridge 71 described with reference to FIG. 21 is loaded on a carriage 87 engaged with a spiral groove 86 of a lead screw 85 rotating through drive force transmission gears 83 and 84 in linkage to the original or reverse rotation of a drive motor 82. The liquid discharge head cartridge 71 is reciprocated in the directions of arrows a and b along a guide 88 together with the carriage 87 by the power of the drive motor 82. A paper pressing plate 90 pressing a medium P to be recorded, conveyed on a platen 89 by a not-shown recording medium supply device, presses the medium P to be recorded, onto the platen 89 over the entire movement region of the carriage 87.

In the vicinity of one end of the lead screw 85, photo couplers 91 and 92 are disposed. These are home position detection means for confirming the presence of a lever 87*a* of the carriage 87 in this region and performing switching of the rotational direction of the drive motor 82, or the like. In FIG. 22, a reference 93 denotes a supporting member supporting a cap member 94 covering the front surface in which the discharge port is provided, in the liquid discharge head of the liquid discharge head cartridge 71. Besides, a reference 95 denotes ink suction means sucking the ink having been discharged emptily or the like from the liquid discharge head and stayed in the interior of the cap member 94. By this ink suction means, the suction recovery of the liquid discharge head is performed through an opening portion (not shown) in the cap.

A reference 96 denotes a cleaning blade, a reference 97 denotes a movement member making the cleaning blade 96 movable in the front and rear directions (directions perpendicular to a movement direction of the above carriage 87), and the cleaning blade 96 and the movement member 97 are supported by a main body supporting body 98. The above cleaning blade 96 is not limited to this form, but may be another well-known cleaning blade. A reference 99 denotes a lever for starting a suction upon a suction recovery operation, and it moves with a movement of a cam 100 engaging with the carriage 87, and the drive force from the drive motor 82 is controlled in movement by known transmission means such as clutch switching or the like. In the liquid discharge device 81, a recording control part (not shown) as recording signal supply means giving a drive signal for discharging a liquid to a heating body 2 provided in the liquid discharge head and managing the drive control of each mechanism described before, is provided in the device main body.

In the liquid discharge device 81, to a medium P to be recorded, conveyed on the platen 89 by a not-shown medium-to-be-recorded conveyance device, the liquid discharge head discharges a liquid with reciprocating over the whole width of the medium P to be recorded, and performs recording onto the medium P to be recorded, by making the discharged liquid adhere to the medium P to be recorded.

What is claimed is:

1. A liquid discharge method which comprising:

a displacement step where a movable member is displaced by generating an electrostatic force between a substrate having a thermal energy generating element for generating thermal energy which is utilized to discharge a liquid through a discharge port and the movable member disposed opposite to the thermal energy generating element and having a free end on a downstream side in a flow direction of the liquid to thereby displace a liquid surface at the discharge port to an upstream side in the flow direction of the liquid, and a discharge step where the movable member is displaced owing to a bubble formed by the thermal energy generated by the thermal energy generating element to discharge the liquid through the discharge port.

2. The liquid discharge method according to claim 1, wherein, in the displacement step, the movable member is displaced in such a direction as to be close to the substrate.

3. The liquid discharge method according to claim 1, wherein, in the discharge step, the movable member is displaced in such a direction as to be apart from the substrate.

4. The liquid discharge method according to claim 1, which further has an additional displacement step where the liquid surface at the discharge port is displaced to the upstream side in the flow direction of the liquid, after the discharge step.

5. The liquid discharge method according to claim 4, wherein, in the additional displacement step, the movable member is displaced by generating the electrostatic force between the substrate and the movable member.

6. The liquid discharge method according to claim 4, wherein, in the displacement step, the movable member is displaced in such a direction as to be close to the substrate.

7. The liquid discharge method according to claim 1, wherein, in the discharge step, a distance of from a displacement fulcrum of the movable member to the free end is changed.

8. A liquid discharge head which comprising:

a substrate having a thermal energy generating element for generating thermal energy which is utilized to discharge a liquid through a discharge port, and a movable member which is disposed opposite to the thermal energy generating element and which has a free end on a downstream side in a flow direction of the liquid and which is equipped with a movable member side electrode for generating an electrostatic force between the movable member side electrode and the substrate, the movable member being displaced owing to a bubble formed by the thermal energy generated by the thermal energy generating element to discharge the liquid through the discharge port.

9. The liquid discharge head according to claim 8, wherein, prior to the generation of the thermal energy by the thermal energy generating element, the electrostatic force is generated between the substrate and the movable member side electrode to displace the movable member and to thereby displace the liquid surface at the discharge port to an upstream side in the flow direction of the liquid.

10. The liquid discharge head according to claim 9, wherein the thermal energy generating element comprises a heat generation resistor and a pair of electrodes connected to the heat generation resistor, and the electrostatic force is generated between the heat generation resistor and the movable member side electrode to displace the movable member.

11. The liquid discharge head according to claim 9, wherein the substrate is equipped with a substrate side electrode, and the electrostatic force is generated between the substrate side electrode and the movable member side electrode to displace the movable member.

12. The liquid discharge head according to claim 11, wherein an inorganic material protective film for protecting the thermal energy generating element is formed on the thermal energy generating element and a metal protective film is formed on the inorganic material protective film, and the substrate side electrode comprises the metal protective film.

13. The liquid discharge head according to claim 12, wherein the metal protective film is made of Ta.

14. The liquid discharge head according to claim 8, wherein the thermal energy generating element is disposed on the substrate so as to be opposite to the movable member.

15. The liquid discharge head according to claim 14, wherein the movable member side electrode is disposed on the movable member so as to be opposite to the plurality of thermal energy generating elements.

16. A head cartridge which integrally comprising:

a liquid discharge head described in claim 8, and a liquid container for accommodating a liquid which is supplied to the liquid discharge head.

17. A liquid discharge device which comprising:

a liquid discharge head described in claim 8, and supply means for giving a drive signal for discharging a liquid from the liquid discharge head.

18. A liquid discharge device which comprising:

a liquid discharge head described in claim 8, and carrier means for carrying a record medium to be recorded with the liquid discharged from the liquid discharge head.

* * * * *

UNITED STATES PATENT AND TRADEMARK OFFICE

CERTIFICATE OF CORRECTION

PATENT NO. : 6,305,783 B1
DATED : October 23, 2001
INVENTOR(S) : Masahiko Kubota et al.

It is certified that error appears in the above-identified patent and that said Letters Patent is hereby corrected as shown below:

Column 2,
Line 1, “is” should be deleted;
Line 17, “is” should be deleted;
Line 33, “is” should be deleted;
Line 61, “is” should be deleted; and
Line 64, “is” should be deleted;

Column 3,
Line 3, “is” should be deleted;
Line 8, “is” should be deleted;
Line 32, “till” should read -- until --; and
Line 48, “by cutting” should read -- a cut --.

Column 4,
Line 20, “by cutting” should read -- a cut --.

Column 5,
Line 20, “comprises” should read -- each comprise --;
Line 43, “by” should read -- such as --;
Line 55, “tion” should read -- ted --;
Line 56, “that” should be deleted; and “by” should read -- which is by --;
Line 57, “is” should be deleted; and
Line 66, “Beside,” should read -- Besides, --.

Column 6,
Line 6, “by cutting” should read -- a cut --; and
Line 14, “is” should read -- is formed such --.

Column 8,
Line 59, “till” should read -- until --.

Column 11,
Line 48, “the” (first occurrence) should be deleted.

Column 12,
Line 20, “by cutting” should read -- a cut --; and
Line 28, “is” should read -- is formed such --.

Column 15,
Line 10, “till” should read -- until --.

UNITED STATES PATENT AND TRADEMARK OFFICE

CERTIFICATE OF CORRECTION

PATENT NO. : 6,305,783 B1
DATED : October 23, 2001
INVENTOR(S) : Masahiko Kubota et al.

It is certified that error appears in the above-identified patent and that said Letters Patent is hereby corrected as shown below:

Column 16,
Line 30, “desire,” should read -- operator’s desire, --;
Line 34, “desire.” should read -- operator’s desire. --; and
Line 64, “the” (second occurrence) should be deleted.

Column 18,
Line 19, “is” should read -- is formed such --.

Column 19,
Line 7, “which” should be deleted;
Line 8, “where” should read -- wherein --;
Line 17, “liquid,” should read -- liquid; --;
Line 18, “where” should read -- wherein --;
Line 30, “where” should read -- wherein --;
Line 45, “which” should be deleted; and
Line 48, “port,” should read -- port; --.

Column 20,
Line 1, “the” should read -- wherein the --;
Line 40, “which” should be deleted;
Line 41, “a” should read -- the --; “described in” should read -- according to --; and “claim 8,” should read -- claim 8; --;
Line 45, “which” should be deleted;
Line 46, “a” should read -- the --; “described in” should read -- according to --; and “claim 8,” should read -- claim 8; --;

UNITED STATES PATENT AND TRADEMARK OFFICE

CERTIFICATE OF CORRECTION

PATENT NO. : 6,305,783 B1
DATED : October 23, 2001
INVENTOR(S) : Masahiko Kubota et al.

It is certified that error appears in the above-identified patent and that said Letters Patent is hereby corrected as shown below:

Column 20 cont'd,
Line 49, "which" should be deleted;
Line 50, "a" should read -- the --; "described in" should read -- according to --;
and "claim 8," should read -- claim 8; --; and
Line 51, "record" should read -- recording --.

Signed and Sealed this

Thirtieth Day of July, 2002

*Attest:*

*Attesting Officer*

JAMES E. ROGAN
*Director of the United States Patent and Trademark Office*